US009555997B2

(12) United States Patent
Yabe

(10) Patent No.: US 9,555,997 B2
(45) Date of Patent: Jan. 31, 2017

(54) PRINTING CONTROL APPARATUS, BINDING CONTROL APPARATUS, AND METHOD FOR CONTROLLING PRINTING CONTROL APPARATUS

(71) Applicant: CANON KABUSHIKI KAISHA, Tokyo (JP)

(72) Inventor: Takashi Yabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/771,555

(22) Filed: Feb. 20, 2013

(65) Prior Publication Data

US 2013/0214471 A1 Aug. 22, 2013

(30) Foreign Application Priority Data

Feb. 22, 2012 (JP) ..... 2012-035975

(51) Int. Cl.

| | |
|---|---|
| ***B65H 39/00*** | (2006.01) |
| ***B65H 39/10*** | (2006.01) |
| ***B31F 5/02*** | (2006.01) |
| ***B42B 5/00*** | (2006.01) |
| ***B65H 37/04*** | (2006.01) |
| ***G03G 15/00*** | (2006.01) |
| ***B42B 4/00*** | (2006.01) |

(52) U.S. Cl.

CPC ..... *B65H 39/00* (2013.01); *B31F 5/02* (2013.01); *B42B 4/00* (2013.01); *B42B 5/00* (2013.01); *B65H 37/04* (2013.01); *B65H 39/10* (2013.01); *G03G 15/6544* (2013.01); *B65H 2301/4213* (2013.01); *B65H 2301/4381* (2013.01); *B65H 2301/43828* (2013.01); *B65H 2301/51616* (2013.01); *B65H 2408/122* (2013.01); *B65H 2701/1829* (2013.01); *B65H 2801/27* (2013.01)

(58) Field of Classification Search

CPC ..... B41C 1/12; B65H 2301/51616; B65H 2301/43828; B65H 2301/43818; B65H 2701/1829; B65H 2301/4381; B65H 39/00; B65H 39/10; B31F 5/02; G03G 15/6541; G03G 15/6544; G03G 2215/00894; G03G 15/655; B42B 5/00

USPC ..... 399/407–410; 270/58.07, 58.08, 58.09, 270/58.12, 58.17

See application file for complete search history.

(56) References Cited

U.S. PATENT DOCUMENTS

| | | | | |
|---|---|---|---|---|
| 2007/0187883 | A1* | 8/2007 | Tokashiki | 270/1.01 |
| 2009/0039585 | A1* | 2/2009 | Hayashi | B42C 1/12 270/58.08 |

(Continued)

FOREIGN PATENT DOCUMENTS

| | | | |
|---|---|---|---|
| CN | 102205916 | A | 10/2011 |
| CN | 102207698 | A | 10/2011 |

(Continued)

*Primary Examiner* — Jennifer Simmons

(74) *Attorney, Agent, or Firm* — Canon U.S.A., Inc. IP Division

(57) ABSTRACT

A printing control apparatus performs binding processing for binding a plurality of sheets without using a staple to enable a user to easily separate a sheet from a sheet bundle after the binding processing. The printing control apparatus causes a binding unit to perform a binding processing for binding a plurality of sheets without using a staple, and then controls the binding unit to perform a binding processing for binding the plurality of sheets and a sheet different from the plurality of sheets.

10 Claims, 28 Drawing Sheets

(56) References Cited

U.S. PATENT DOCUMENTS

| | | | | |
|---|---|---|---|---|
| 2009/0232527 | A1* | 9/2009 | Shida | 399/44 |
| 2011/0222945 | A1* | 9/2011 | Sato | 399/408 |
| 2011/0233844 | A1* | 9/2011 | Shiraishi | B65H 31/3027 270/58.11 |

FOREIGN PATENT DOCUMENTS

| | | | |
|---|---|---|---|
| CN | 102275762 | A | 12/2011 |
| CN | 102336085 | A | 2/2012 |
| CN | 102344051 | A | 2/2012 |
| JP | 8-300847 | A | 11/1996 |
| JP | 2004-209869 | A | 7/2004 |
| JP | 2006-103344 | A | 4/2006 |
| JP | 04492721 | B2 | 6/2010 |
| JP | 2010-208097 | A | 9/2010 |
| JP | 2011207560 | A | 10/2011 |

* cited by examiner

PRINTING CONTROL APPARATUS, BINDING CONTROL APPARATUS, AND METHOD FOR CONTROLLING PRINTING CONTROL APPARATUS

BACKGROUND OF THE INVENTION

1. Field of the Invention

Aspects of the present invention generally relate to a printing control apparatus for controlling binding processing for binding a plurality of sheets, a binding control apparatus, a method for controlling the printing control apparatus, and a program therefore.

2. Description of the Related Art

Some of image processing apparatuses having copy and printer functions are provided with a sheet processing apparatus for applying to output print sheets. One of typical functions provided by the sheet processing apparatus is a staple binding function. The staple binding function is a function of binding sheets with a metal staple.

Since a stapled print product is easy to handle on a volume basis, staple binding is widely used when handling an output product having a plurality of pages.

Recently, however, in consideration of the environment, some binding methods without using a metal staple (hereinafter referred to as stapleless binding methods) have been discussed so as not to use the metal staples. For example, there is a stapleless binding method that collectively cuts out a part of a set of print sheets subjected to binding so as to bore the sheets, and folds down the tips of the cut portions (refer to Japanese Patent Application Laid-Open No. 8-300847).

As described above, various types of stapleless binding methods have been put in practical use. These methods have different characteristics from binding methods using a metal staple (hereinafter referred to as staple binding methods). For example, with a staple binding method using a metal staple, bound sheets cannot be unbound without removing the staple. However, with a stapleless binding method for binding sheets by applying pressure thereto from the upside and downside (in the thickness direction) to make them closely contact and bind, bound sheets can be easily unbound because the sheets are bound only by pressure. However, conventional image processing apparatuses are provided only with a staple-based sheet processing apparatus, and a technique for unbinding the bound sheets taking advantage of the feature of stapleless binding processing has not been discussed.

Therefore, there has been an issue that, when a user circulate a document in an office, it is necessary to print and staple the document, print a circulation slip separately from the document, and attach the circulation slip to the document by using a clip or the like. There has also been an issue that, when a user discards a cover after circulation, disposal of a staple and clip is needed.

SUMMARY OF THE INVENTION

Aspects of the present invention relate to providing a user with a print product that is easy to separate a sheet from a sheet bundle after binding processing by applying the binding processing to a plurality of sheets without using a staple.

According to an aspect of the present invention, a printing control apparatus for controlling a binding unit that performs a binding processing for binding a plurality of sheets without using a staple includes a printing unit configured to perform printing on a sheet, and a control unit configured to control the binding unit to perform a binding processing for binding a plurality of sheets printed by the printing unit, and then control the binding unit to perform a binding processing for binding the plurality of sheets and a sheet different from the plurality of sheets.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
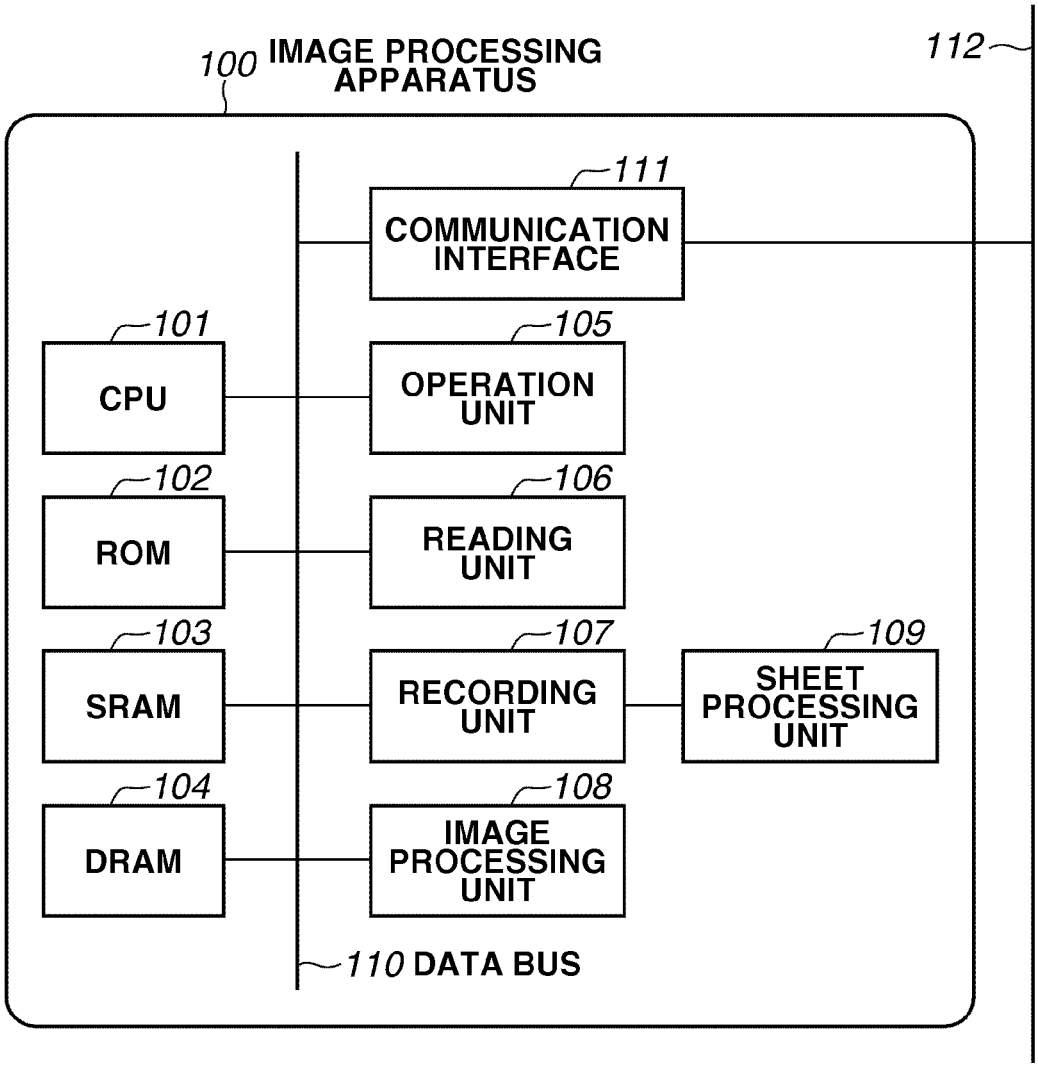
FIG. 1 is a block diagram illustrating a configuration of an image processing apparatus.

FIG. 1 is a block diagram illustrating a configuration of an image processing apparatus 100 according to the present exemplary embodiment, where the image processing apparatus 100 is an example of a printing control apparatus. While the following description to the image processing apparatus 100, any apparatus that would function as a printing control apparatus would be applicable. In the present exemplary embodiment, a sheet processing apparatus that performs sheet is implemented as part of the image processing apparatus 100 having a reading function of reading an image and a printing function of printing an image on a sheet. In another embodiment, the sheet processing apparatus is implemented as an apparatus separate from the image processing apparatus. In each case, the image processing apparatus 100 including the sheet processing apparatus and the sheet processing apparatus as a separate apparatus, function as a binding control apparatus that performs a binding processing on sheets.

Referring to FIG. 1, a central processing unit (CPU) 101 is a control unit of a system for controlling the entire apparatus. A read-only memory (ROM) 102 stores a control program for the CPU 101. A static random access memory (SRAM) 103 stores setting values and management data of the apparatus that are registered by an operator, and various working buffers. Since the SRAM. 103 is a nonvolatile SRAM backed up by a battery, stored contents of the SRAM 103 are retained even after the power of the apparatus is turned off. The SRAM 103 also stores read image data.

A dynamic random access memory (DRAM) 104 stores program control parameters. An operation unit 105 is a user interface that displays information inside the apparatus. The operation unit 105 can display a user interface screen described below. A reading unit 106 reads image data and converts it into binary data. The reading unit 106 is used to read a document during execution of an image transmission function.

A recording unit 107 prints image data on a sheet. An image processing unit 108 performs coding and decoding processing on image data handled by the image transmission function. The above-described function units are connected via a data bus 110, and image data is transferred through the data bus 110.

The recording unit 107 is connected to a sheet processing unit 109. A sheet printed by the recording unit 107 is conveyed to the sheet processing unit 109. The sheet processing unit 109 performs such as straightening up input sheets, switching output trays, and performing binding processing for binding a plurality of sheets. The present exemplary embodiment distinctively describes two different binding processing, namely first binding processing for binding a sheet bundle using a staple and second binding processing for binding a sheet bundle without using staple.

With the thus-configured image processing apparatus, the reading unit 106 reads a document image, converts the image into binary data, and once stores the read image data in the SRAM 103. An example of printing control will be described below, in which the image processing unit 108 converts the image data stored in the SRAM 103, the recording unit 107 prints the image on a sheet, and the sheet processing unit 109 performs post-print processing (i.e., binding processing).

Figure 2:
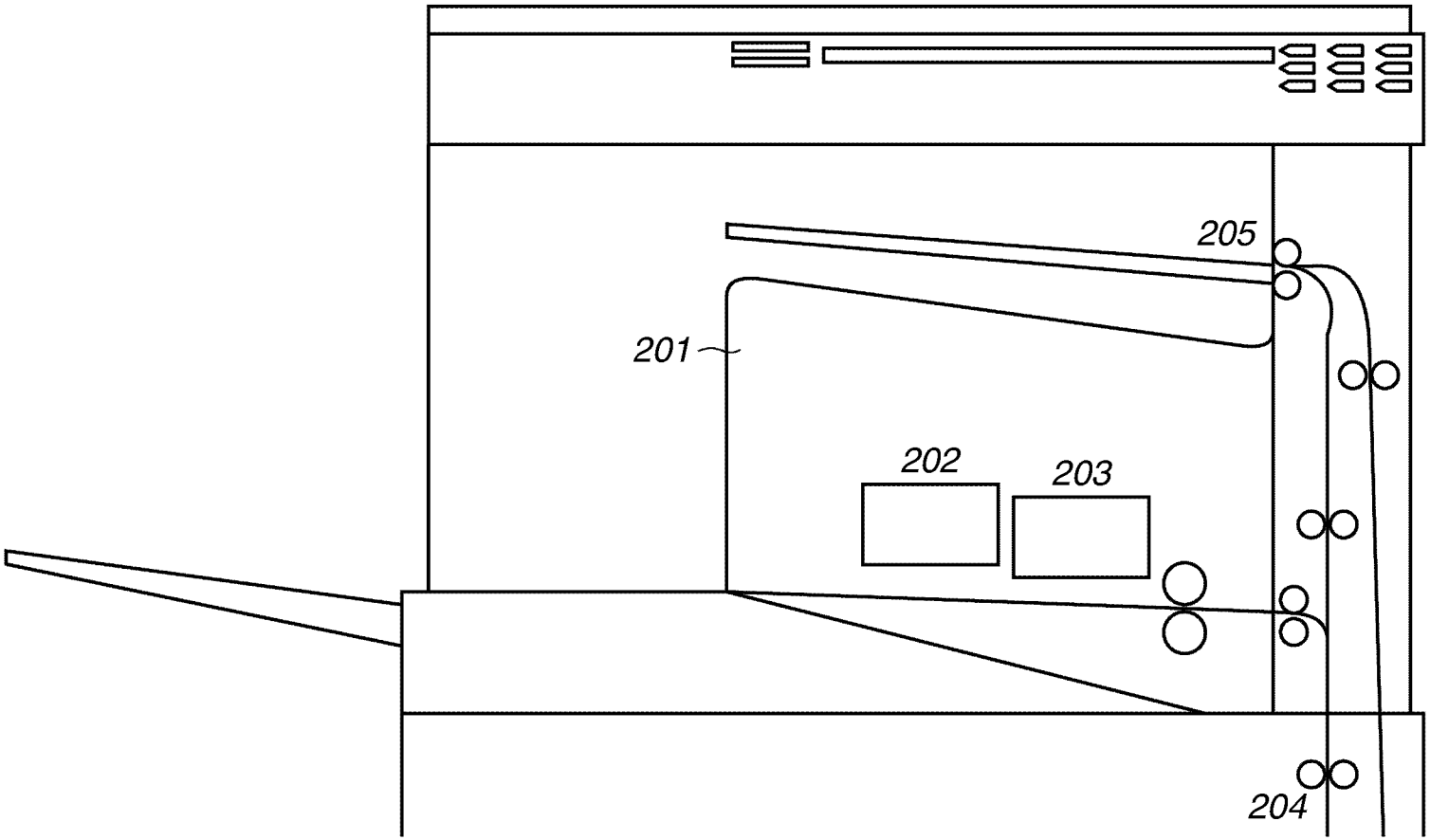
FIG. 2 is a cross sectional view illustrating an example configuration of a sheet processing unit.

FIG. 2 is a cross sectional view illustrating in more detail an example of a configuration of the sheet processing unit 109 illustrated in FIG. 1. In this example, the sheet processing unit 109 is installed in the housing of the sheet processing apparatus of the image processing apparatus.

Descriptions of the recording unit 107 including an engine unit for executing print processing will be omitted. The sheet processing unit 109 is used being connected to the main body unit of the image processing apparatus. Although connection modes of the sheet processing unit 109 include the in-line mode and other modes, the application of the present invention is not limited thereto.

Referring to FIG. 2, a sheet processing apparatus 201 is used being connected to the recording unit 107. A sheet is conveyed from the recording unit 107 to the sheet processing apparatus 201 via conveyance roller 204. A conveyance roller 205 reverses a sheet at the time of two-sided printing. After being reversed, the sheet enters the recording unit 107 again via the conveyance roller 205, and printing is performed on the rear surface of the sheet. In this case, an output sheet is sent to the sheet processing apparatus 201 via the conveyance roller 204.

Although the sheet processing apparatus 201 is provided with a function of straightening up output sheets and a function of moving output sheets, a binding function will be focused.

A first binding unit 202 is a stapler having a staple binding function that uses a metal staple to bind sheets. A second binding unit 203 has a stapleless sheet binding function that does not use a metal staple to bind sheets. Although there are many types of stapleless binding methods as described above, the sheet processing unit 201 is provided with a stapleless binding method for binding sheets by applying pressure thereto from the upside and downside in the thickness direction to make them closely contact.

Thus, the sheet processing apparatus 201 including both the first binding unit 202 and the second binding unit 203 is described as an example of the present exemplary embodiment. However, the sheet processing apparatus 201 may include only the second binding unit 203 that performs stapleless binding. A case where the sheet processing apparatus 201 is provided with both the first binding unit 202 and the second binding unit 203, and a case where it is provided only with the second binding unit 203 will be described below.

Figure 3:
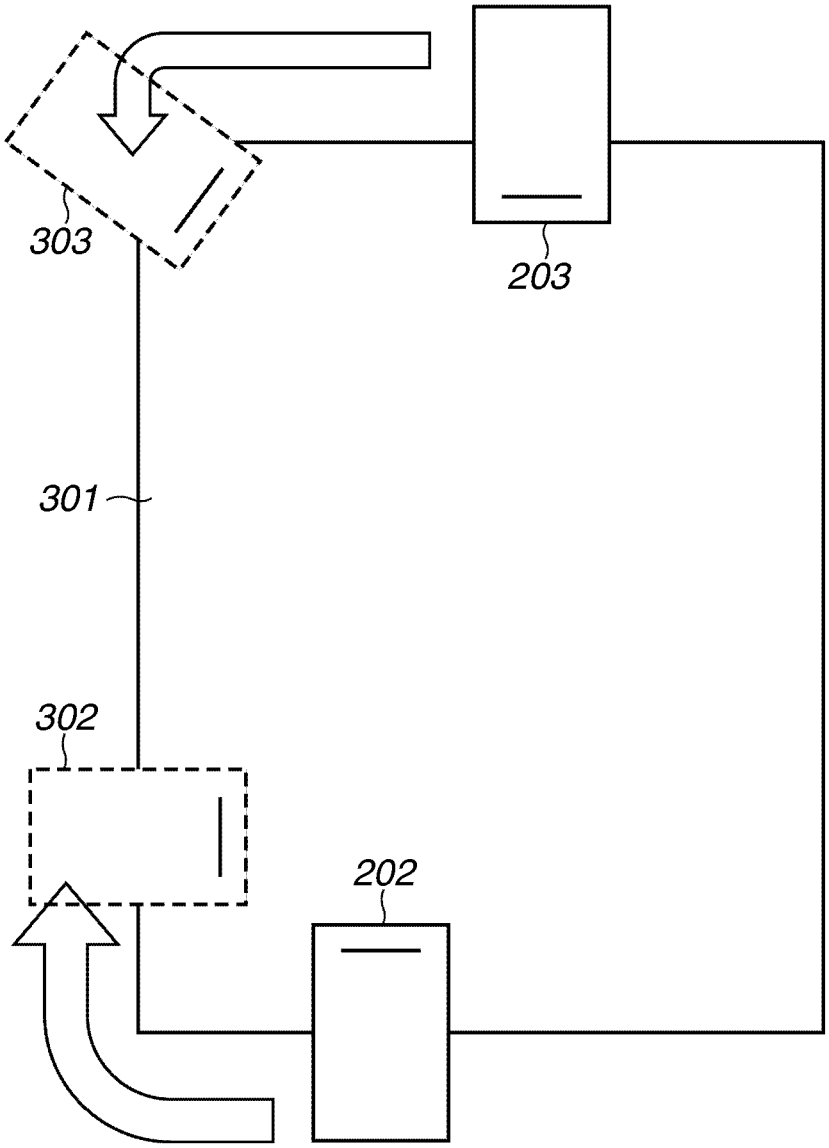
FIG. 3 illustrates arrangements of binding portions and binding work areas.

FIG. 3 illustrates arrangements of the first binding unit 202 and the second binding unit 203 illustrated in FIG. 2, and binding work areas thereof.

FIG. 3 illustrates a state where the first binding unit 202 is stopped at a standby position on a sheet 301 to be subjected to binding. When the sheet 301 is actually bound, the first binding unit 202 moves from the standby position to a binding position 302 indicated by an arrow and then performs sheet binding. Although a mechanism for moving the first binding unit 202 is omitted, its movement is controlled by an instruction from the CPU 101.

Likewise, the second binding unit 203 that performs stapleless binding is regularly stopped at a standby position and, when actually binding the sheets, moves from the standby position to a binding position 303 and then performs sheet binding. As described above, the first binding unit 202 and the second binding unit 203 can move under the control of the CPU 101 illustrated in FIG. 1 according to a binding method.

Figure 4A:
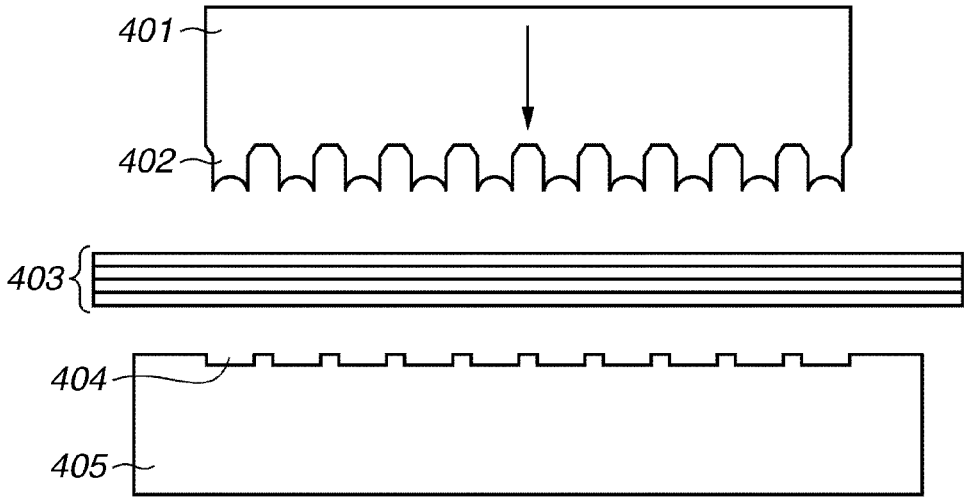
FIGS. 4A and 4B are cross sectional views illustrating binding processing by a second binding unit illustrated in FIG. 2.
Figure 4B:
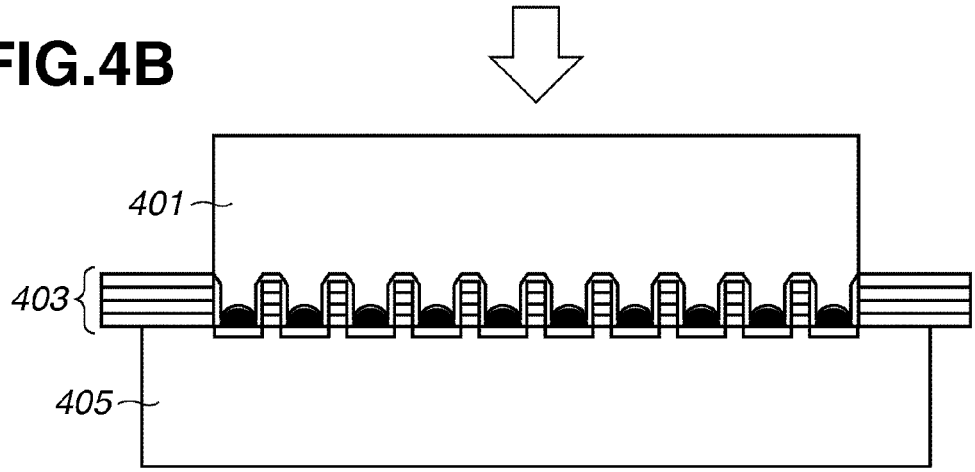

FIGS. 4A and 4B are cross sectional views illustrating binding processing by the second binding unit 203 illustrated in FIG. 2. A stapleless binding method for binding sheets by applying pressure thereto from the upside and downside in the thickness direction to make them closely contact will be described below. More specifically, FIG. 4A illustrates a state where output sheets are set at the binding position, and the second binding unit 203 has moved to the binding position 303, as illustrated in FIG. 3.

Referring to FIGS. 4A and 4B, an upper mold 401 applies pressure onto the sheets from the upside. The upper mold 401 is provided with a plurality of convex shape blades. Applying pressure onto the sheets at a plurality of portions enables preventing the sheets from easily being apart. A lower mold 405 applies pressure onto the sheets from the downside. The lower mold 405 is provided with a plurality of concave portions 404 corresponding to convex portions 402 of the upper mold 401 to engage with the convex blades of the upper mold 401.

Figure 5:
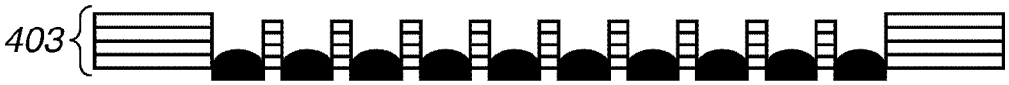
FIG. 5 is a cross sectional view illustrating binding processing by the second binding unit illustrated in FIG. 2.

As illustrated in FIG. 4B, the upper mold 401 and the lower mold 405 apply pressure onto an output sheet bundle 403 from the upside and downside, respectively, by using a pressurization mechanism (not illustrated), thus binding the output sheet bundle 403. The cross section of the output sheet bundle 403 after binding is as illustrated in FIG. 5. When the sheet bundle 403 is viewed from above, a binding position 601 is as illustrated in FIG. 6.

Figure 6:
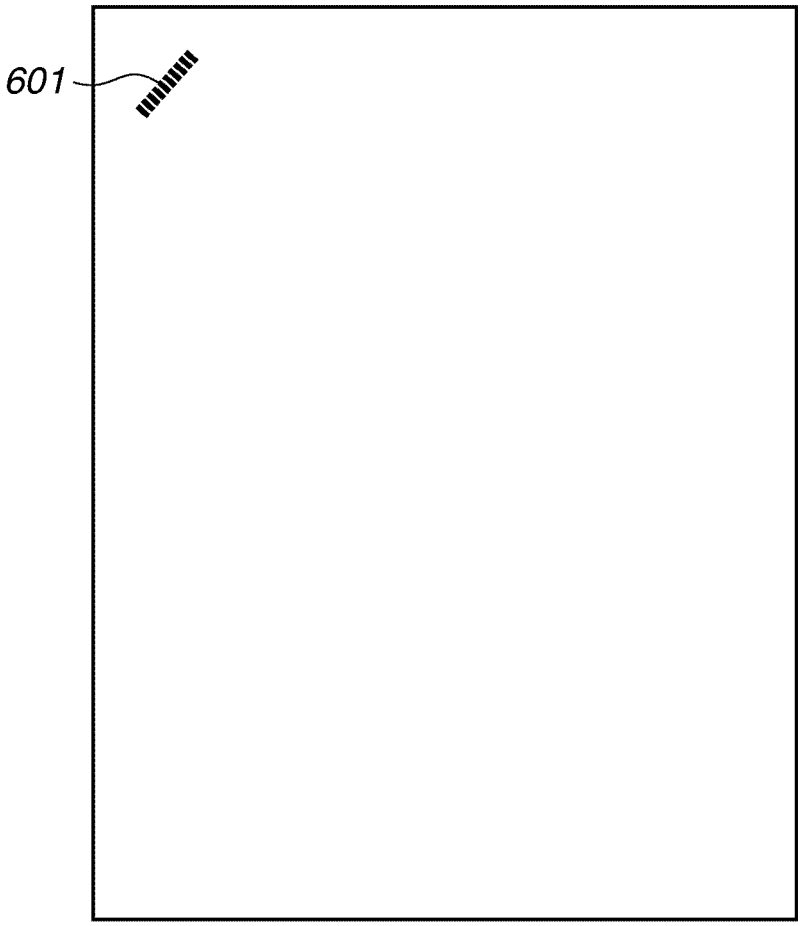
FIG. 6 illustrates a binding position.

According to the present exemplary embodiment, black portions at the binding position 601 illustrated in FIG. 6 indicate sheet portions pressurized and crushed. Since this method uses pressure, the number of bindable sheets is limited at present. Further, binding processing can be applied twice because a binding force to be applied in one binding processing may be weak.

Figure 7B:
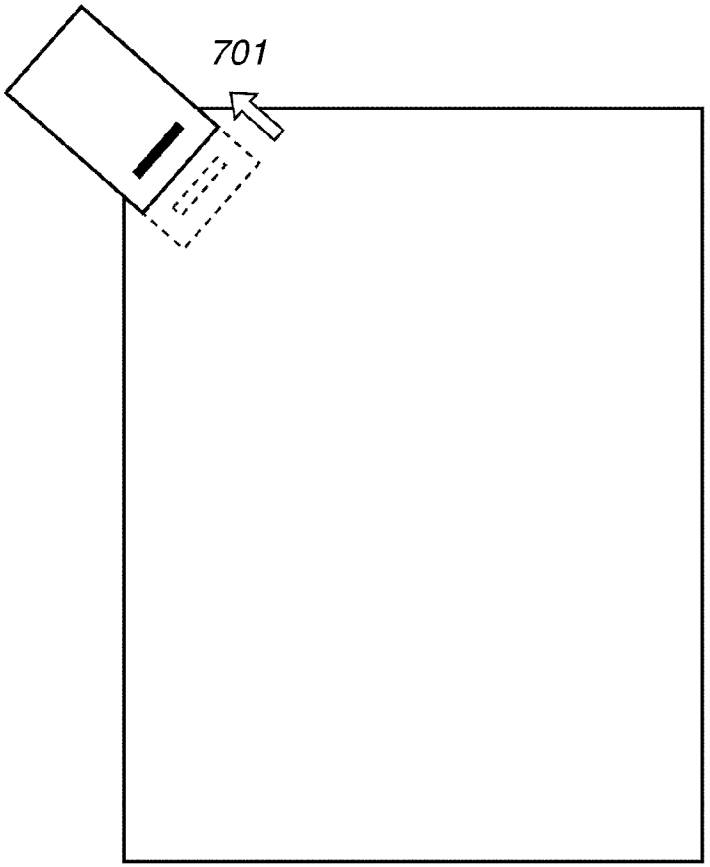
FIGS. 7A and 7B illustrate binding positions.
Figure 7A:
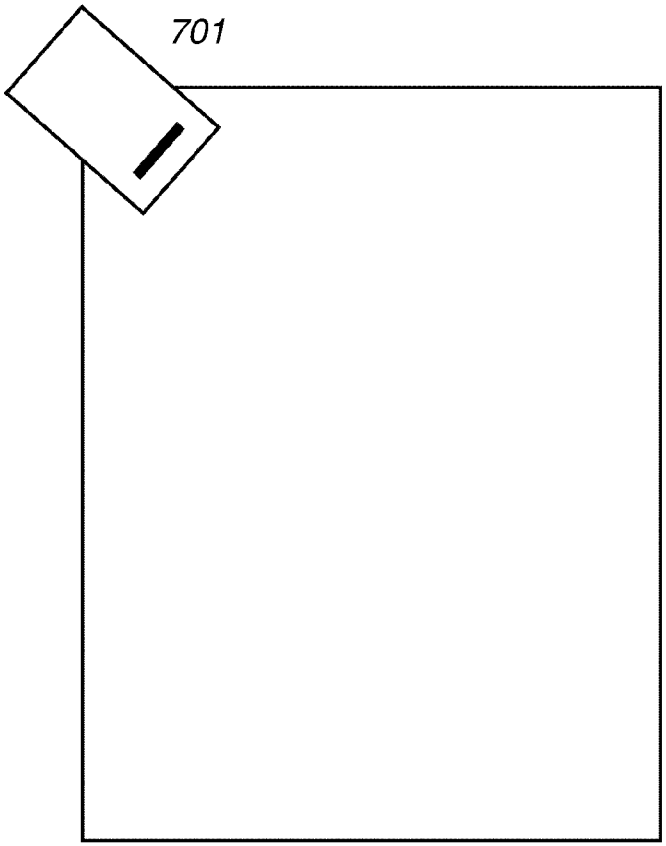

FIGS. 7A and 7B illustrate binding positions of the second binding unit 203 illustrated in FIG. 2. Referring to FIGS. 7A and 7B, the second binding unit 203 can move the binding position from the position illustrated in FIG. 7A in an arrow direction illustrated in FIG. 7B. The second binding unit 203 can change the binding position and the number of binding times by adjusting the amount of movement.

Figure 8:
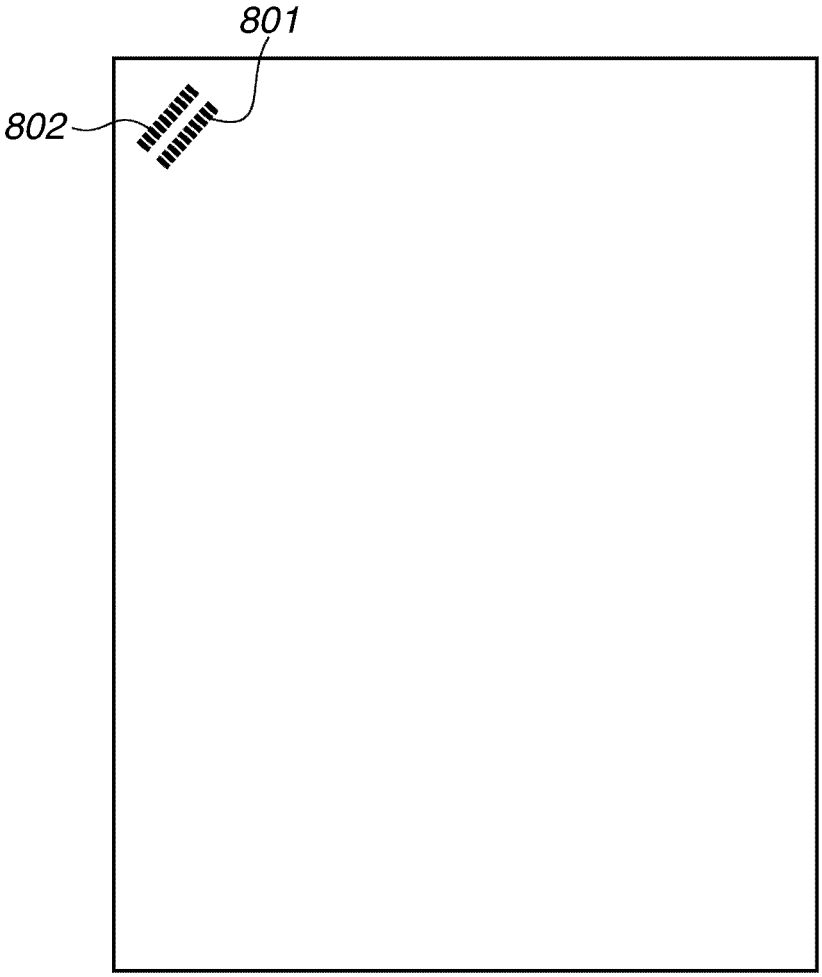
FIG. 8 illustrates binding positions.

FIG. 8 illustrates the number of binding times and the binding position of the second binding unit 203 illustrated in FIG. 2. FIG. 8 illustrates an example of the output sheet 301 bound twice when viewed from the top.

Referring to FIG. 8, a binding portion 801 is formed at a first binding position 701 illustrated in FIG. 7A by the binding processing of the second binding unit 203. A binding portion 802 is formed, after movement of the second binding unit 203, at another position illustrated in FIG. 7B by the binding processing of the second binding unit 203. Increasing the number of black portions at the pressurized portion illustrated in FIG. 8 increases the amount of pressing, thus increasing the binding force. With the stapleless binding method, rubbing the pressurized bound portion with a nail or the like enables finely unbinding the sheets without tearing the sheets.

Figure 9:
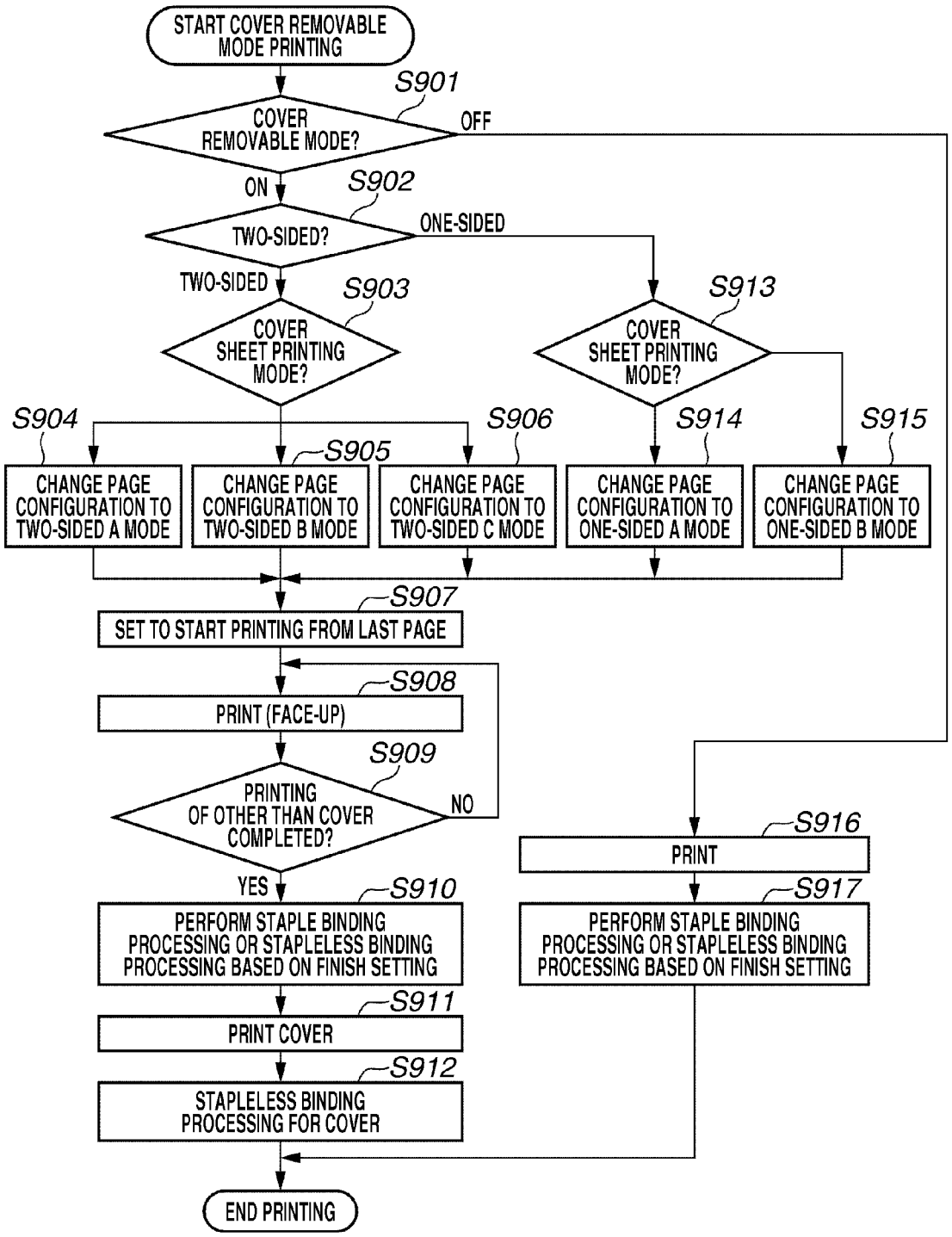
FIG. 9 is a flowchart illustrating a method for controlling the printing control apparatus.

FIG. 9 is a flowchart illustrating a method for controlling the printing control apparatus according to the present exemplary embodiment. This example illustrates processing of a mode in which a cover can be removed from the following sheet after performing the second binding processing. Each step is implemented when the CPU 101 illustrated in FIG. 1 executes a program for executing the processing in the flowchart in FIG. 9 (described below) stored in the ROM 102.

Printing control according to the present exemplary embodiment will be described below with reference to user interface screens (UI screens) illustrated in FIGS. 10 to 16. The UI screens illustrated in FIGS. 10 to 17 are displayed on a display unit of the operation unit 105 illustrated in FIG. 1 under the control of the CPU 101. The display unit of the operation unit 105 includes a touch panel. When the user operates a displayed button, the CPU 101 determines the operated button and then executes setting processing for various print modes.

The following describes a case in which, when binding processing by the second binding unit 203 is specified, the CPU 101 controls binding processing by the first and second binding units 202 and 203 so that the first binding unit 202 applies binding processing to a sheet bundle and then the second binding unit 203 applies binding processing to the bound sheet bundle and a sheet. When the user presses a COPY button 1004 on the UI screen (i.e., a copy operation screen) illustrated in FIG. 10, the CPU 101 starts the processing of the flowchart in FIG. 9, i.e., the processing proceeds to step S901.

Figure 14:
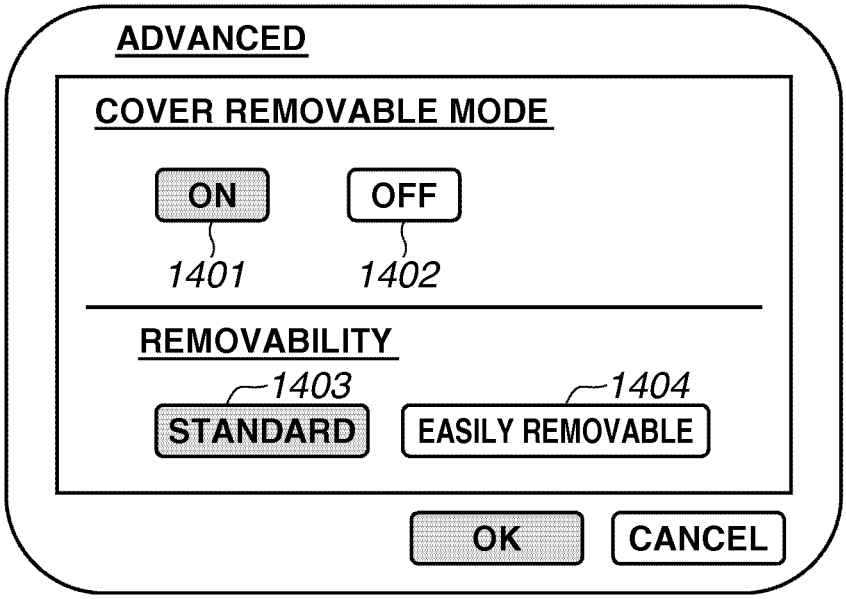
FIG. 14 illustrates an example of a UI screen displayable on the operation unit.

In step S901, the CPU 101 determines whether a cover removable mode is set to an ON state or an OFF state, for example, on the UI screen illustrated in FIG. 14 displayed on the display unit of the operation unit 105.

Display control for displaying a cover removable mode setting screen 14 will be described below.

Figure 10:
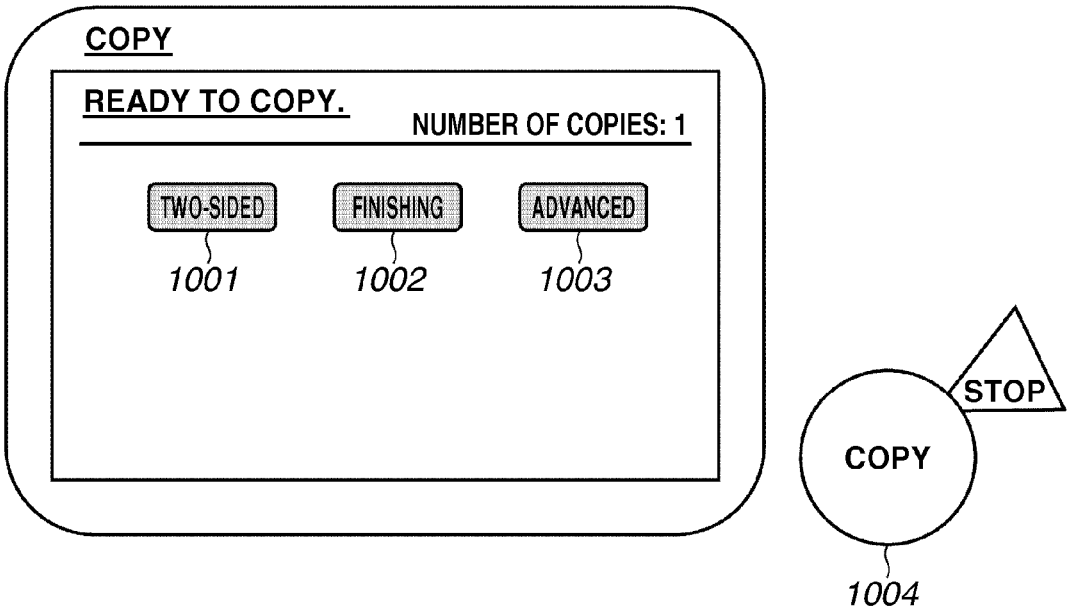
FIG. 10 illustrates an example of a user interface (UI) screen displayable on an operation unit.

In the cover removable mode, the CPU 101 determines whether the user presses an ADVANCED button 1003 on the UI screen illustrated in FIG. 10. When the CPU 101 determines that the user presses the ADVANCED button 1003 among a TWO-SIDED button 1001, a FINISHING button 1002, and the ADVANCED button 1003, the CPU 101 performs control to change the UI screen to a UI screen illustrated in FIG. 13 (i.e., an advanced mode setting screen) to enable the user to select the cover removable mode.

Figure 13:
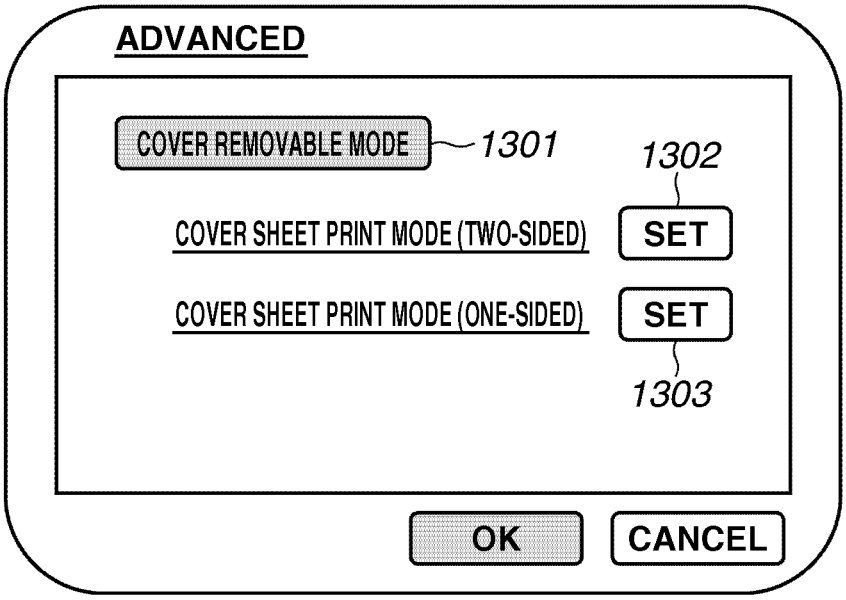
FIG. 13 illustrates an example of a UI screen displayable on the operation unit.

Further, the CPU 101 determines whether the user presses a COVER REMOVABLE MODE button 1301 on the UI screen illustrated in FIG. 13. When the CPU 101 determines that the user presses the COVER REMOVABLE MODE button 1301, the CPU 101 performs control to select a cover removable mode setting screen (FIG. 14) as the UI screen to be displayed on the display unit of the operation unit 105.

The UI screen illustrated in FIG. 14 can display the current setting of the cover removable mode, namely an ON state 1401 or an OFF state 1402. The cover removable mode state is currently set to the ON state 1401 in FIG. 14.

If the CPU 101 determines that the cover removable mode is set to the ON state 1401 (ON in step S901), the processing proceeds to step S902. Whereas if the CPU 101 determines that the cover removable mode is set to the OFF state 1402 (OFF in step S901), the processing proceeds to step S916.

In step S916, the CPU 101 controls the recording unit 107 to perform printing on a sheet and convey the printed sheet to the sheet processing unit 109, and the processing proceeds to step S917. In step S917, the CPU 101 controls the finishing operation of the sheet processing unit 109 to bind the sheets set on the UI screen illustrated in FIG. 10.

Figure 12:
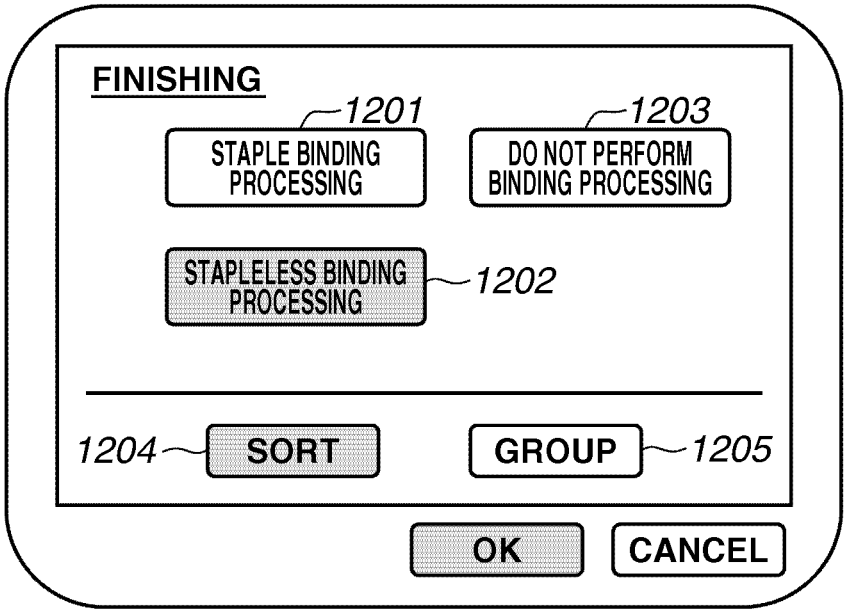
FIG. 12 illustrates an example of a UI screen displayable on the operation unit.

When the user presses the FINISHING button 1002 for setting the finishing processing, the CPU 101 displays the UI screen illustrated in FIG. 12.

The UI screen illustrated in FIG. 12 enables the user to select the binding mode from "STAPLE BINDING PROCESSING" 1201, "STAPLELESS BINDING PROCESSING" 1202, and "DO NOT PERFORM BINDING PROCESSING" 1203. In addition, the UI screen enables the user to select the finishing mode from "SORT" 1204 or "GROUP" 1205.

On the UI screen illustrated in FIG. 12, "STAPLELESS BINDING PROCESSING" 1202 and "SORT" 1204 are currently selected. In this example, in step S917, the CPU 101 controls the sheet processing unit 109 to bind the sheets through the stapleless binding processing in the sort mode. When the CPU 101 completes the processing in step S917, i.e., the control of the sheet processing unit 109, printing is completed, and the processing in the flowchart in FIG. 9 is terminated.

Figure 11:
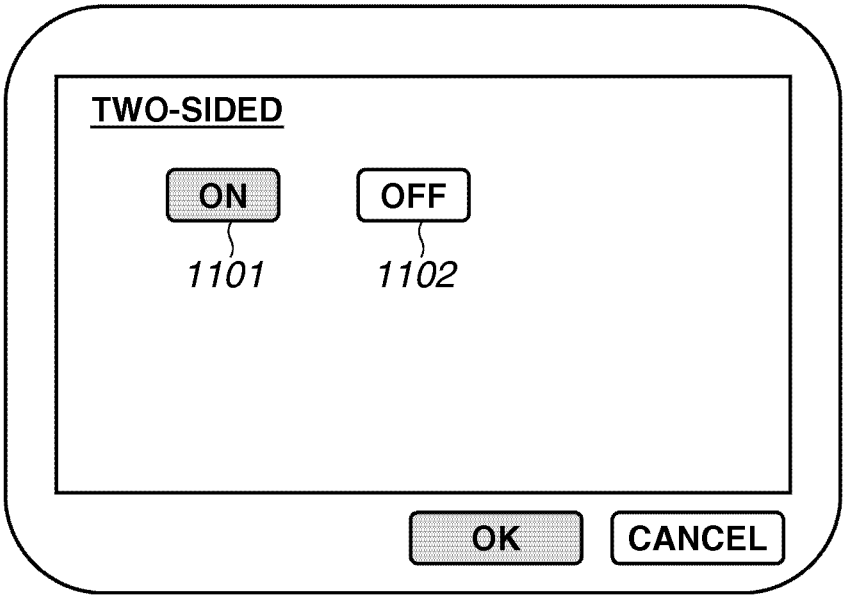
FIG. 11 illustrates an example of a UI screen displayable on the operation unit.

In step S902, the CPU 101 determines which of the ON state 1101 (two-sided setting) and the OFF state 1102 (one-sided setting) is selected on the UI screen illustrated in FIG. 11.

If the CPU 101 determines that the user presses the TWO-SIDED button 1001 on the UI screen illustrated in FIG. 10 (TWO-SIDED in step S902), the CPU 101 displays the UI screen illustrated in FIG. 11 to enable two-sided setting.

FIG. 11 illustrates that the two-sided printing is set to the ON state. If the CPU 101 determines that two-sided printing is set to the ON state 1101 (TWO-SIDED in step S902), the processing proceeds to step S903. Whereas if the CPU 101 determines that two-sided printing is set to the OFF state 1102 (ONE-SIDED in step S902), the processing proceeds to step S913. The processing in step S903 (TWO-SIDED) and subsequent steps will be described below.

Figure 15:
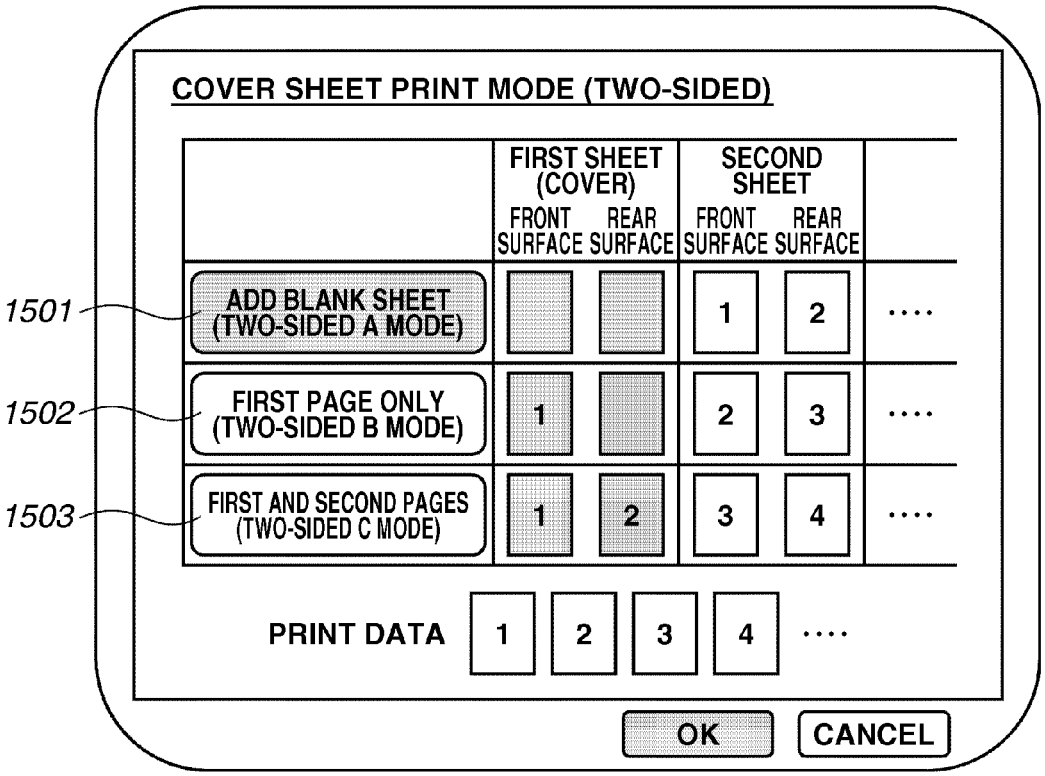
FIG. 15 illustrates an example of a UI screen displayable on the operation unit.

In step S903, the CPU 101 determines what is selected for the "COVER SHEET PRINT MODE (TWO-SIDED)" setting on the UI screen illustrated in FIG. 15. When the CPU 101 determines in step S903 that "ADD BLANK SHEET (TWO-SIDED A MODE)" 1501 is selected on the UI screen illustrated in FIG. 15, the processing proceeds to step S904.

Figure 17:
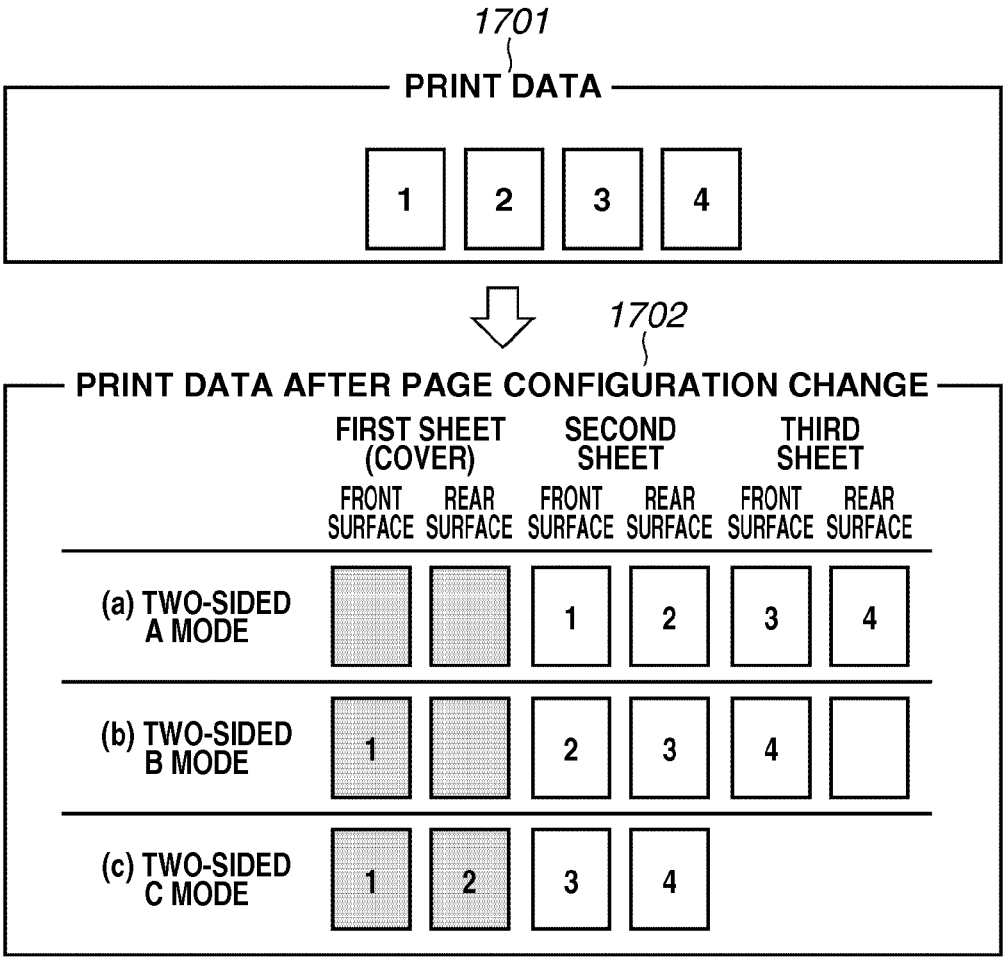
FIG. 17 illustrates a page configuration of print data.

In step S904, in the case of print data 1701 as illustrated in FIG. 17, the CPU 101 determines that a blank sheet is to be added as a cover. Then, the CPU 101 performs control to change the page configuration for the print data 1701 to "(a) TWO-SIDED A MODE" illustrated in FIG. 17 in which a blank sheet is output as the first sheet (cover).

On the other hand, when the CPU 101 determines in step S903 that "FIRST PAGE ONLY (TWO-SIDED B MODE)" 1502 is selected on the UI screen illustrated in FIG. 15, the processing proceeds to step S905.

In step S905, the CPU 101 performs control to change the page configuration for the print data 1701 to "(b) TWO-SIDED B MODE" illustrated in FIG. 17 in which only the first page of the print data 1701 is printed on the cover. This mode is used in a case where a circulation slip is provided as a first page, the circulation slip is printed on the cover, and, after use, the cover (circulation slip) is removed and discarded. Whereas if the CPU 101 determines in step S903 that "FIRST AND SECOND PAGES (TWO-SIDED C MODE)" 1502 is selected on the UI screen illustrated in FIG. 15, the processing proceeds to step S906.

In step S906, the CPU 101 performs control to change the page configuration for the print data 1701 to "(c) TWO-SIDED C MODE" illustrated in FIG. 17 in which the first and second pages of the print data 1701 are printed on the cover. When the CPU 101 completes control to change the page configuration for the print data 1701 as described above, the processing proceeds to step S907.

In step S907, the CPU 101 sets the recording unit 107 to print the last page first and the cover last. When the CPU 101 completes setting, the processing proceeds to step S908.

In step S908, the CPU 101 controls the recording unit 107 to perform face-up printing so that the front surface of the cover is faced up on the top. Then, the CPU 101 starts printing control and the processing proceeds to step S909.

In step S909, the CPU 101 determines whether printing is completed for other than the cover. When the CPU 101 determines that printing is not completed for other than the cover (NO in step S909), the processing returns to step S908 and the CPU 101 controls the recording unit 107 to print the next page.

When the CPU 101 determines that printing is completed for other than the cover (YES in step S909), the processing proceeds to step S910.

In step S910, the CPU 101 performs control the sheet processing unit 109 to perform binding processing according to the FINISHING setting on the UI screen illustrated in FIG. 12. For example, since "STAPLELESS BINDING PROCESSING" 1202 is selected on the UI screen illustrated in FIG. 12, the CPU 101 controls the sheet processing unit 109 to apply binding processing at the binding position 701 illustrated in FIG. 7A. As a result, the sheets are bound as illustrated in FIG. 18A. When the CPU 101 completes control for the finishing processing, the processing proceeds to step S911.

In step S911, the CPU 101 controls the recording unit 107 to print the page assigned to the cover by the change in the page configuration. When the CPU 101 completes printing control for the cover, the processing proceeds to step S912.

In step S912, the CPU 101 sets the finishing processing performed by the sheet processing unit 109 to the stapleless binding processing and then controls the sheet processing unit 109 to perform binding processing to bind the sheets. In this case, as illustrated in FIG. 7B, the CPU 101 controls the sheet processing unit 109 to move the second binding unit 203 to the outer side of the sheet than the regular position illustrated in FIG. 7A and then perform binding processing so that the user can easily remove the cover.

Figure 18B:
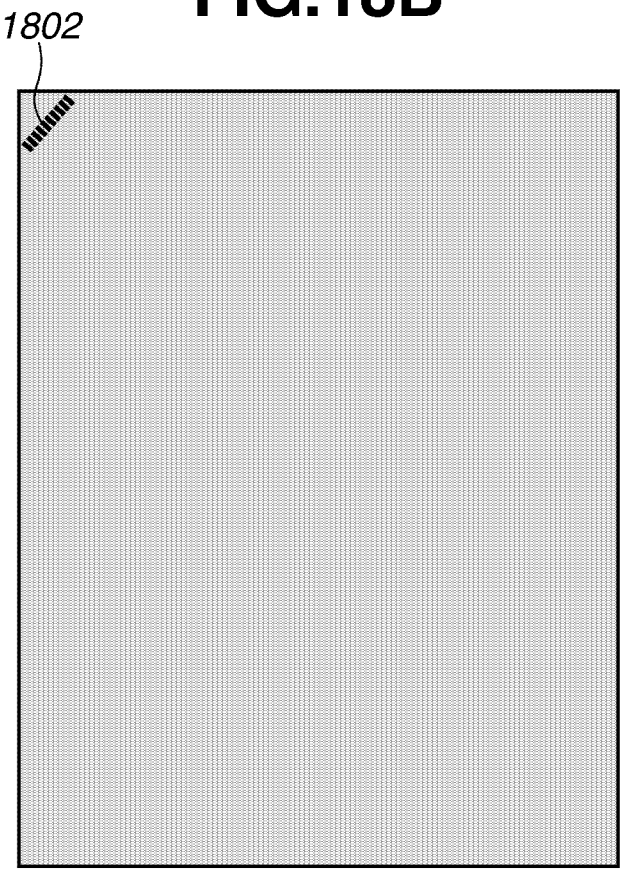
FIGS. 18A and 18B illustrate binding positions.
Figure 18A:
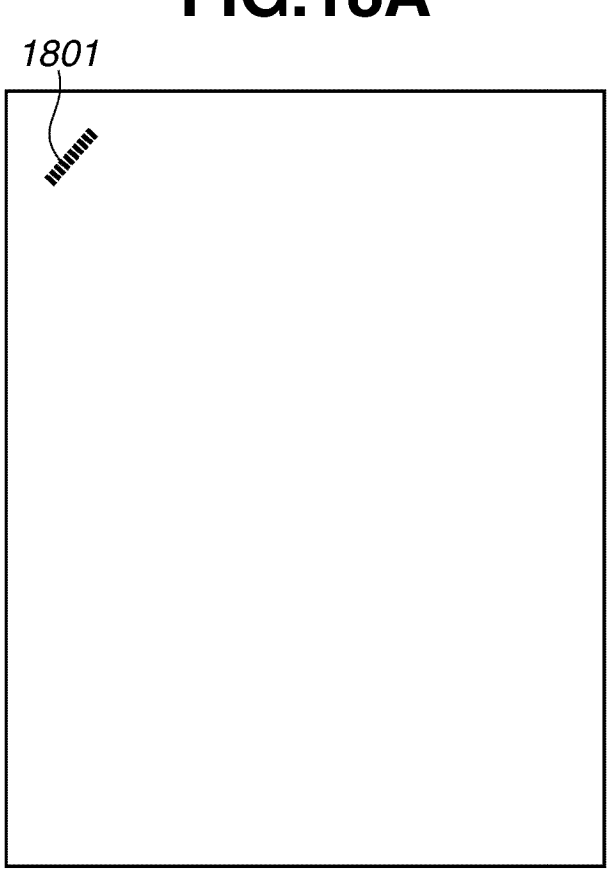
Figure 19:
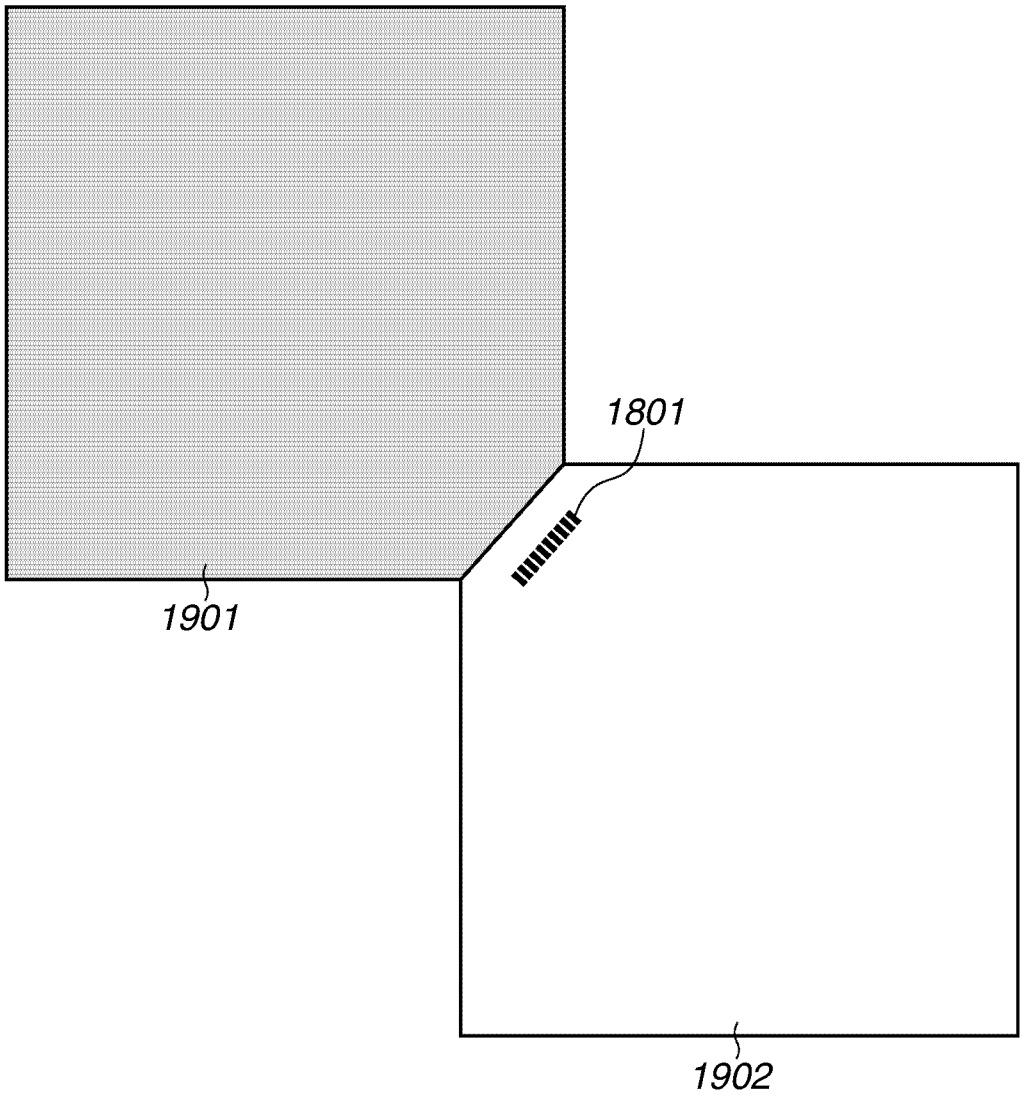
FIG. 19 illustrates a binding position.

As a result, the output sheets are bound at a position as illustrated in FIG. 18B. Performing control to shift the binding position enables the user to easily remove only a cover 1901 put on the upper surface of a sheet bundle 1902 without affecting a binding portion 1801 of the sheet bundle 1902 (not the cover), as illustrated in FIG. 19. When the CPU 101 completes the processing in step S912, printing is completed, and the processing in the flowchart in FIG. 9 is terminated.

The following describes the processing in step S913 and subsequent steps to be executed when the CPU 101 determines that two-sided printing is set to the OFF state (one-sided) in step S902.

Figure 16:
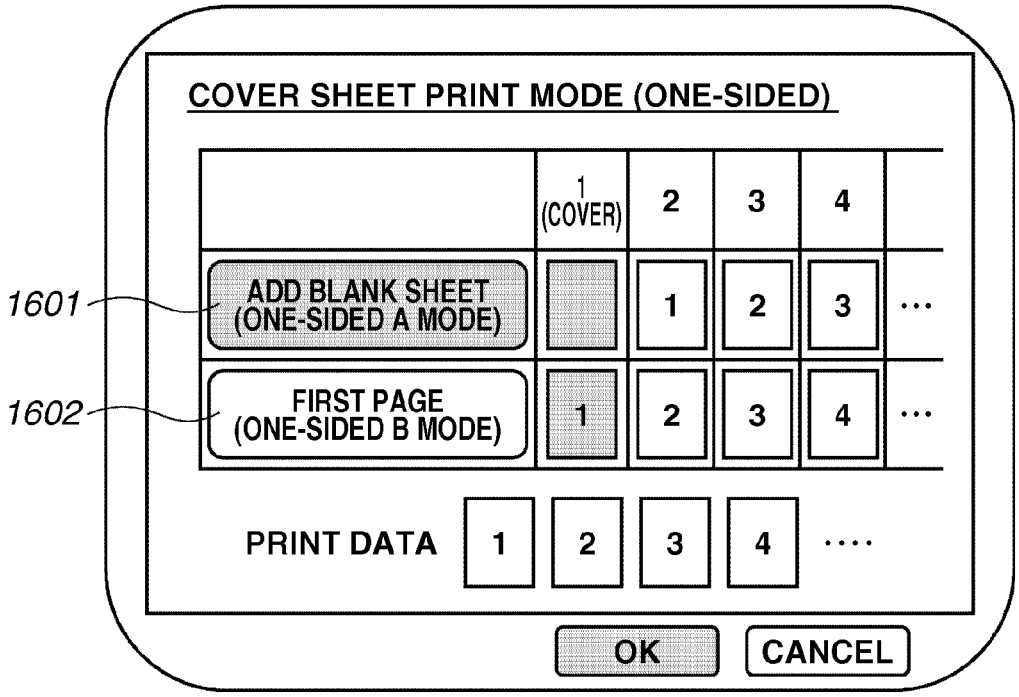
FIG. 16 illustrates an example of a UI screen displayable on the operation unit.

In step S913, the CPU 101 determines what mode is selected by the user on the UI screen (the "COVER SHEET PRINT MODE (ONE-SIDED)" screen) illustrated in FIG. 16. When the CPU 101 determines that "ADD BLANK SHEET (ONE-SIDED A MODE)" 1601 is selected by the user on the UI screen illustrated in FIG. 16, the processing proceeds to step S914.

In step S914, the CPU 101 performs control to change the page configuration for the print data 1701 as a mode for adding a blank sheet as the cover so that a blank sheet is output as the first sheet. When the CPU 101 determines that "FIRST PAGE (ONE-SIDED B MODE)" 1602 is selected by the user on the UI screen illustrated in FIG. 16, the processing proceeds to step S915.

In step S915, the CPU 101 performs control to change the page configuration for the print data 1701 so that the first page of the print data 1701 is printed on the cover. When the CPU 101 completes control to change the page configuration as described above, the processing proceeds to step S907.

The processing in step S907 and subsequent steps is similar to that in the two-side mode, redundant description will be omitted.

In the above-described exemplary embodiment, a case where "STAPLELESS BINDING PROCESSING" 1202 is selected for the FINISHING setting on the UI screen illustrated in FIG. 12. Now, a case where "STAPLE BINDING PROCESSING" 1201 is selected will be described below.

Figure 20A:
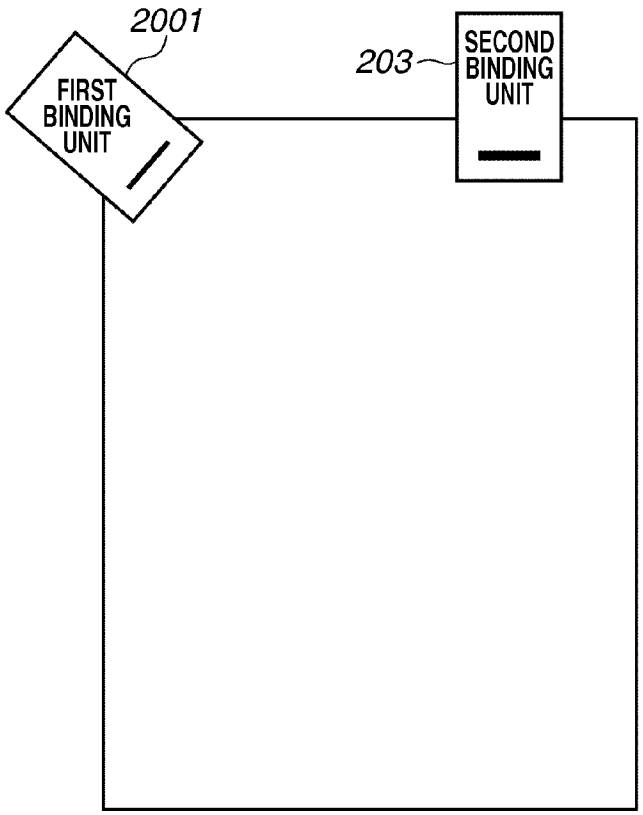
FIGS. 20A and 20B illustrate binding positions.
Figure 21B:
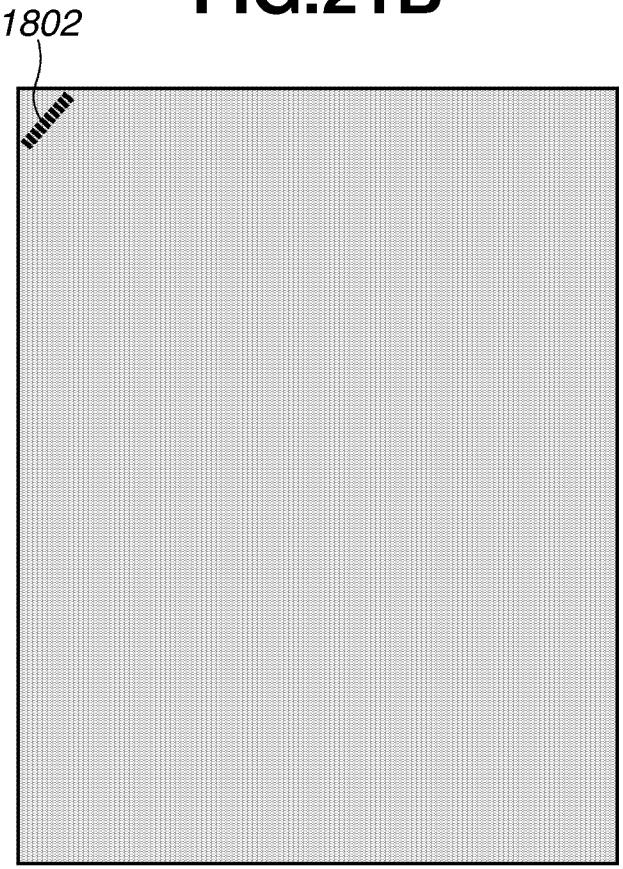
FIGS. 21A and 21B illustrate binding positions.
Figure 21A:
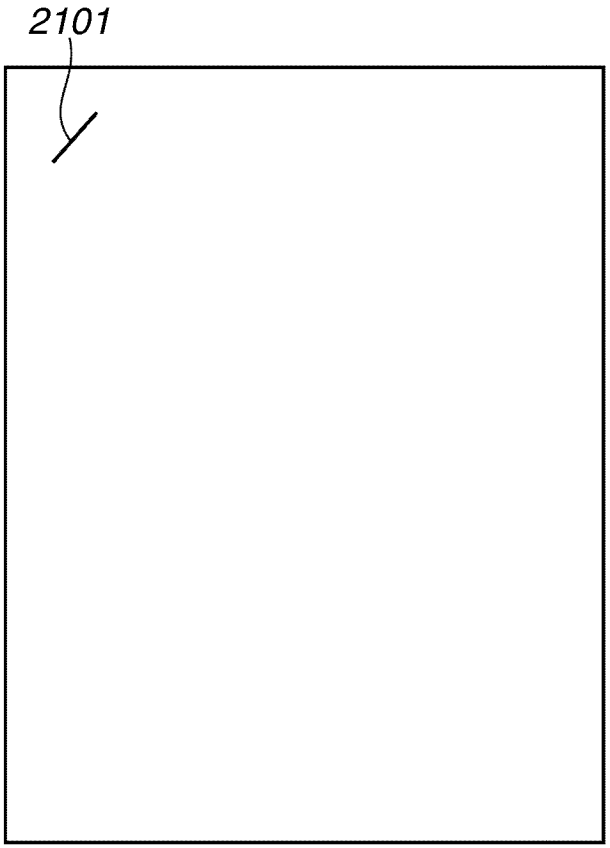

In step S910 illustrated in FIG. 9, the CPU 101 controls the sheet processing unit 109 to apply the staple binding processing to the binding position 2001 illustrated in FIG. 20A. After the CPU 101 performs the above-described control, a binding state 2101 as illustrated in FIG. 21A is formed.

Figure 20B:
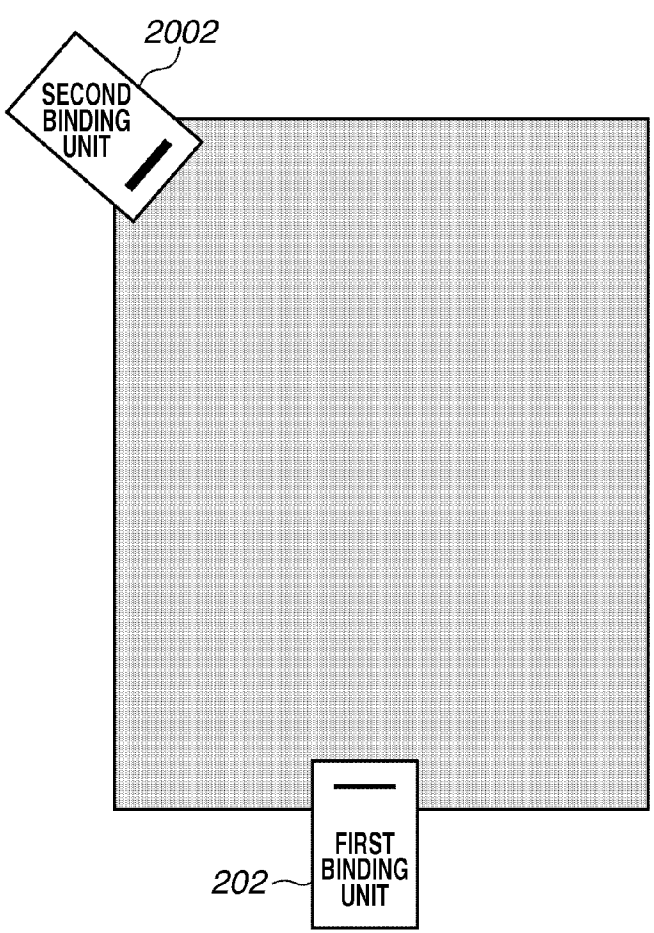

In step S912, the CPU 101 controls the sheet processing unit 109 to perform the stapleless binding processing so that the user can easily remove the cover, as described above. More specifically, the sheet processing unit 109 applies the stapleless binding processing to a binding position 2002 illustrated in FIG. 20B, and a binding state 1802 as illustrated in FIG. 21B is formed. Thus, the cover removable mode can be achieved by binding the cover without using a staple only through the stapleless binding processing or through a combination of the stapleless binding processing and the staple binding processing.

In addition, the CPU 101 can determine which of "STANDARD" 1403 and "EASILY REMOVABLE" 1404 is selected on the UI screen illustrated in FIG. 14 and control the sheet processing unit 109 based on the selection.

Figure 22:
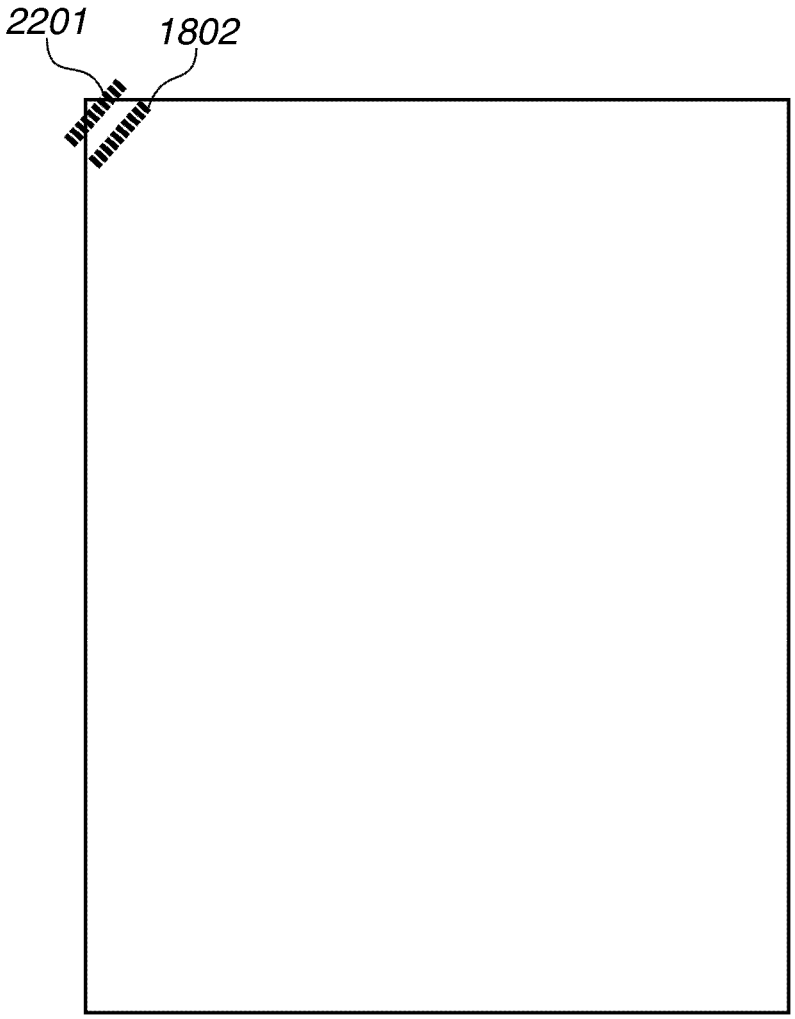
FIG. 22 illustrates binding positions.

More specifically, when "STANDARD" 1403 is selected, the CPU 101 controls the sheet processing unit 109 to make the sheets closely contact with each other by all of the 10 convex portions illustrated in FIGS. 4A and 4B, as illustrated by the stapleless binding state 1802 in FIG. 22. On the other hand, when "EASILY REMOVABLE" 1404 is selected, the CPU 101 controls the sheet processing unit 109 to make the sheets closely contact with each other by some (five) of the 10 convex portions, as illustrated by a stapleless binding state 2201 in FIG. 22.

Reducing the number of contact portions in this way decreases the contact force between sheets, so that the user can easily remove the cover. This processing can be achieved when the CPU 101 controls the sheet processing unit 109 to adjust the position of the stapleless binding processing illustrated in FIG. 7. More specifically, when binding processing by the second binding unit 203 is specified, the CPU 101 controls the second binding unit 203 to apply binding processing to the sheet bundle and then secondly apply binding processing to a position different from the former binding position.

Although, in the above-described exemplary embodiment, binding processing is applied during a copy operation, it is of course that the processing in the flowchart in FIG. 9 provides a similar effect also in a case of printing a Page Description Language (PDL) document received from a data processing apparatus. Example data processing apparatuses include a device capable of communicating with the image processing apparatus via a wired or wireless interface, and a server apparatus in the cloud computing environment.

According to the present exemplary embodiment, the cover removable mode enables easily attaching a cover such as a circulation slip that will be lastly discarded without user's work. In addition, when the cover is lastly discarded, a user can easily remove the cover without the need for discarding a staple.

Further, according to the present exemplary embodiment, a user can easily switch between the cover removable mode and the conventional mode. Since the present exemplary embodiment allows the user to select a page to be used as a cover in the cover removable mode, the user can set the cover as desired. Further, the present exemplary embodiment allows the user to select the removability of the cover in the cover removable mode, and enables providing the user with a mode in which the cover can be removed as desired by the user.

In the first exemplary embodiment, a case is described in which, after the second binding processing, sheet post-processing is performed so as to prevent a cover from arbitrarily being opened and pages following a cover from being looked at. In a second exemplary embodiment, an example is described in which, after the second binding processing, binding processing is performed to prevent pages following a cover from arbitrarily being looked at. For example, dual page binding prevents the contents from easily being looked at.

Figure 23:
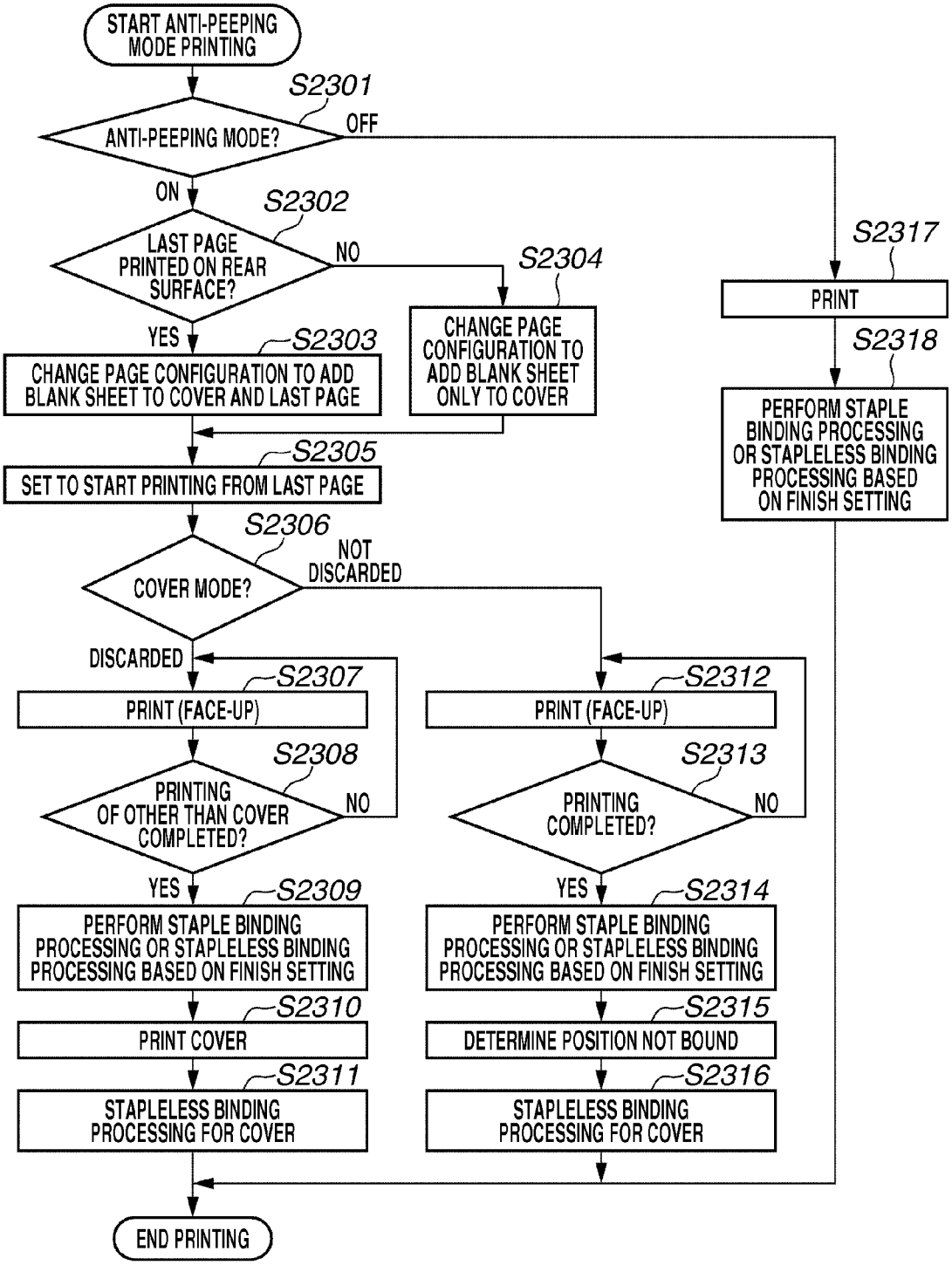
FIG. 23 is a flowchart illustrating a method for controlling the printing control apparatus.

FIG. 23 is a flowchart illustrating a method for controlling the printing control apparatus according to the present exemplary embodiment. This example illustrates processing of a mode in which a cover can be removed from the following sheet after performing the second binding processing. Each step is implemented when the CPU 101 illustrated in FIG. 1 executes a program for executing the processing in the flowchart in FIG. 23 (described below) stored in the ROM 102.

The following describes a case where, when binding processing is specified, the CPU 101 controls the first binding unit 202 to apply binding processing to the sheet bundle and then controls the second binding unit 203 to apply binding processing to the bound sheet bundle and a sheet.

When a user presses the COPY button 1004 on the UI screen illustrated in FIG. 10, the CPU 101 starts the processing of the flowchart in FIG. 23, and the processing proceeds to step S2301.

Figure 24:
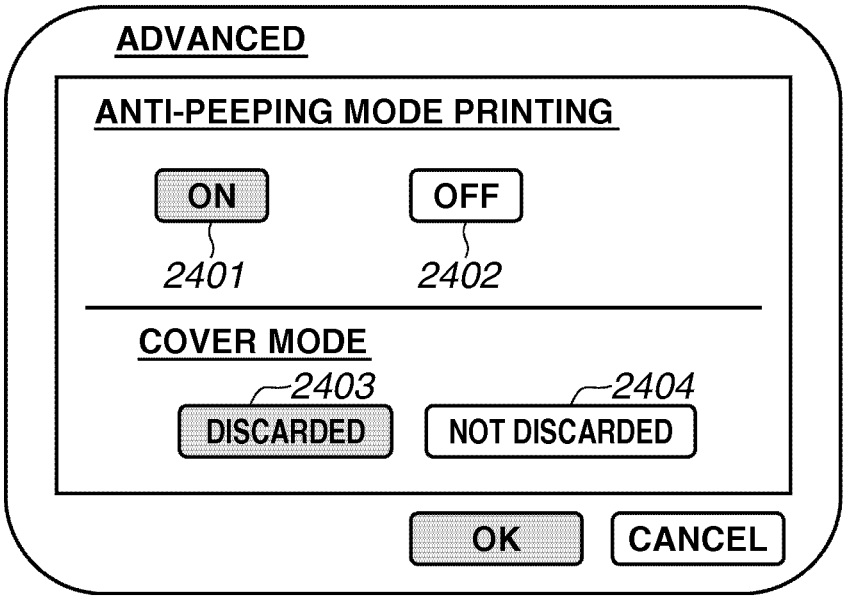
FIG. 24 illustrates an example of a UI screen displayable on the operation unit.

In step S2301, the CPU 101 determines whether the user sets an anti-peeping mode for the advanced setting to an ON state or an OFF state on the UI screen illustrated in FIG. 24. If the CPU 101 determines that the user sets the anti-peeping mode to the ON state 2401 (ON in step S2301), the processing proceeds to step S2302. Whereas if the CPU 101 determines that the user sets the anti-peeping mode to the OFF state 2402 (OFF in step S2301), the processing proceeds to step S2317.

A case where the anti-peeping mode is set to the OFF state 2402 will be described below.

In step S2317, the CPU 101 controls the recording unit 107 to perform printing on a sheet and then convey the printed sheet to the sheet processing unit 109, and the processing proceeds to step S2318.

In step S2318, the CPU 101 controls the sheet processing unit 109 to apply the finishing processing according to the finishing processing set by the FINISHING button 1002 illustrated in FIG. 10 to the sheets to bind them. As the finishing processing by the FINISHING button 1002, the user can select "STAPLE BINDING PROCESSING" 1201 or "STAPLELESS BINDING PROCESSING" 1202, and select "SORT" 1204 or "GROUP" 1205, as illustrated in FIG. 12.

FIG. 12 illustrates that "STAPLELESS BINDING PROCESSING" 1202 and "SORT" 1204 are selected. With this setting, in step S2318, the CPU 101 controls the sheet processing unit 109 to perform the stapleless binding processing in the sort mode to bind the sheets. Then, printing is completed, and the processing in the flowchart in FIG. 23 is terminated.

A case where the anti-peeping mode is set to the ON state 2401 will be described below.

In step S2302, the CPU 101 determines whether the last page is printed on the rear surface of the sheet. This determination is made because if the last page is printed on the rear surface of the sheet, the last page of the output product can be easily looked at simply by turning it over.

Accordingly, the CPU 101 determines whether the last page is printed on the rear surface of the sheet, and when the CPU 101 determines that the last page is printed on the rear surface of the sheet, the CPU 101 adds a sheet to prevent the output product from easily being looked at simply by turning it over.

More specifically, if the CPU 101 determines that the last page is printed on the rear surface of the sheet (YES in step S2302), the processing proceeds to S2303. Whereas if the CPU 101 determines that the last page is printed not on the rear surface of the sheet (NO in step S2302), the processing proceeds to step S2304.

In step S2303, the CPU 101 changes the page configuration of the print data 1701 to add a blank sheet as the cover and the last page so that the front and rear surfaces of the output product may be hidden, thus preventing the print product from being looked at.

In step S2304, the CPU 101 changes the page configuration of the print data 1701 to add a blank sheet only to the cover since the CPU 101 determines that printing is not performed on the rear surface of the output product. When the CPU 101 has changed the page configuration of the print data 1701, the processing proceeds to step S2305.

In step S2305, the CPU 101 sets the recording unit 107 to start printing from the last page to enable the stapleless binding processing to be performed at last so that the user can easily remove the cover. When the CPU 101 completes print setting, the processing proceeds to step S2306.

In step S2306, the CPU 101 determines which of "DISCARDED" 2403 and "NOT DISCARDED" 2404 for the COVER MODE setting is selected on the UI screen illustrated in FIG. 24. According to the present exemplary embodiment, the UI screen illustrated in FIG. 24 allows the user to select "DISCARDED" 2403 when the user will remove and discard the cover or "NOT DISCARDED" 2404 when the user will not remove and discard the cover.

If the CPU 101 determines that the COVER MODE setting is "DISCARDED" 2403 (DISCARDED in step S2306), the processing proceeds to step S2307. Whereas if the CPU 101 determines that the COVER MODE setting is "NOT DISCARDED" 2404 (NOT DISCARDED in step S2306), the processing proceeds to step S2312.

The processing in step S2307 and subsequent steps for removing and discarding the cover in use will be described below.

In step S2307, the CPU 101 controls the recording unit 107 to perform printing based on the face-up print setting so that the front surface of the cover sheet is faced up on the top. When the CPU 101 controls the recording unit 107 to start printing, the processing proceeds to step S2308.

In step S2308, the CPU 101 determines whether printing is completed for other than the cover. If the CPU 101 determines that printing is not completed for other than the cover (NO in step S2308), the processing returns to step S2307 and the CPU 101 controls the recording unit 107 to print the next page.

Whereas if the CPU 101 determines that printing is completed for other than the cover (YES in step S2308), the processing proceeds to step S2309.

In step S2309, the CPU 101 controls the sheet processing unit 109 to bind the sheets according to the FINISHING setting on the UI screen illustrated in FIG. 12. For example, since "STAPLELESS BINDING PROCESSING" 1202 is selected in the UI screen illustrated in FIG. 12, the sheet binding processing is applied to the binding position 701 illustrated in FIG. 7A. As a result, the binding state illustrated in FIG. 18A is formed. When the CPU 101 completes the processing in step S2309, the processing proceeds to step S2310.

In step S2310, the CPU 101 controls the recording unit 107 to print the page assigned to the cover by the change in the page configuration. Thus, when the CPU 101 completes cover printing control, the processing proceeds to step S2311.

In step S2311, the CPU 101 controls the sheet processing unit 109 to set the stapleless binding processing so that the cover can be removed and to bind the sheets. In this case, as illustrated in FIG. 7B, the CPU 101 controls the sheet processing unit 109 to move the second binding unit 203 to the outer side of the sheet than the regular position illustrated in FIG. 7A and then perform binding processing so that the user can easily remove the cover.

Figure 25B:
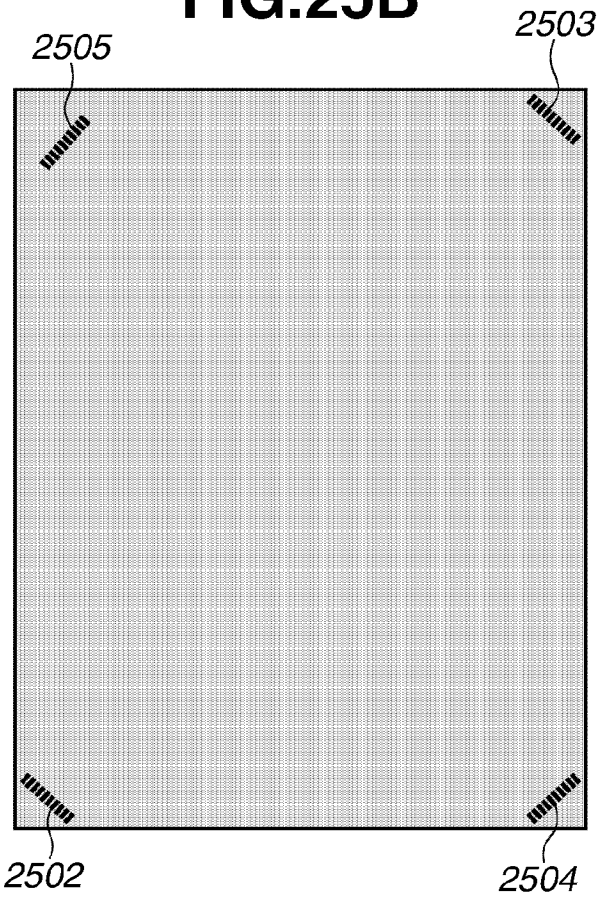
FIGS. 25A and 25B illustrate binding positions.
Figure 25A:
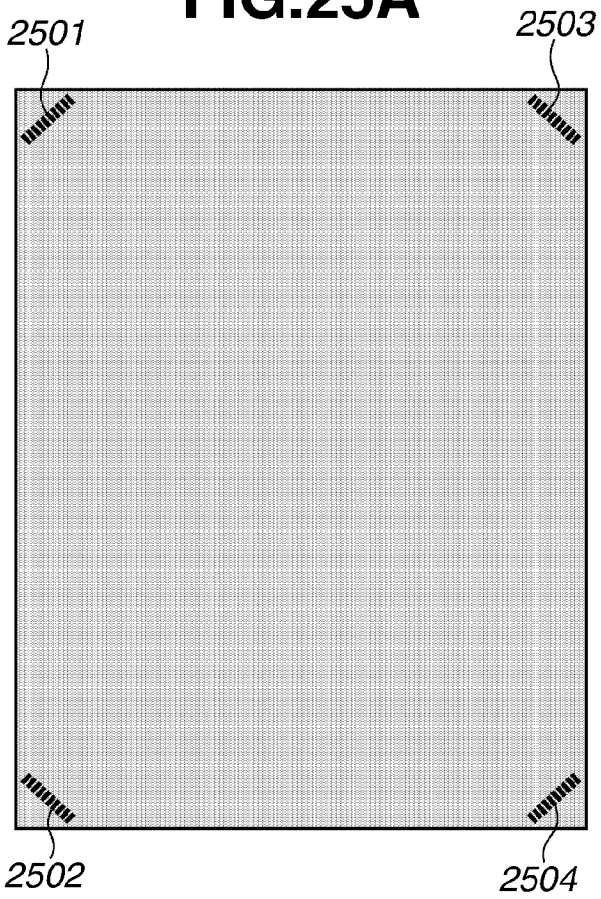

The binding processing according to the present exemplary embodiment is different from that in the first exemplary embodiment in that the CPU 101 controls the sheet processing unit 109 to bind the four corners as illustrated in FIG. 25A so that the pages other than the cover are hidden. Binding the four corners enables preventing the print product from being peeped by other users.

Figure 26A:
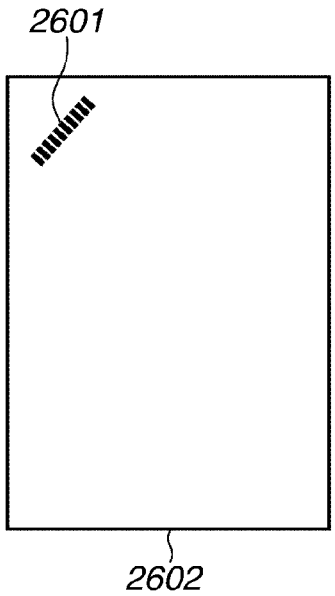
FIGS. 26A and 26B illustrate binding positions.

If a user rubs the four corners with his/her nail or the like, the user can easily remove and discard the cover, and separate each page. As a result, the print product is as illustrated in FIG. 26A and the user can look at the contents. When the CPU 101 completes the processing in step S2311, printing is completed, and the processing in the flowchart in FIG. 23 is terminated.

The processing in step S2312 and subsequent steps for not removing and discarding the cover in use will be described below.

In step S2312, the CPU 101 controls the recording unit 107 to perform face-up printing so that the front surface of the cover is faced up on the top. When the CPU 101 controls the recording unit 107 to start printing, the processing proceeds to step S2313.

In step S2313, the CPU 101 determines whether printing is completed. When the CPU 101 determines that printing is not completed (NO in step S2313), the processing returns to step S2312 and the CPU 101 controls the recording unit 107 to print the next page. When the CPU 101 determines that printing is completed (YES in step S2313), the processing proceeds to step S2314.

In step S2314, the CPU 101 controls the sheet processing unit 109 to bind the sheets according to the FINISHING setting set on the UI screen illustrated in FIG. 12. For example, since "STAPLELESS BINDING PROCESSING" 1202 is selected in the UI screen illustrated in FIG. 12, the sheet binding processing is applied to the binding position 701 illustrated in FIG. 7A. As a result, the binding state illustrated in FIG. 18A is formed. When the CPU 101 completes the processing in step S2314, the processing proceeds to step S2315.

In step S2315, the CPU 101 determines the bound position in FIG. 18A and then determines the remaining three corners not bound yet out of the four corners to achieve dual page binding. Then, the processing proceeds to step S2316 and the CPU 101 binds the remaining three positions.

In step S2316, the CPU 101 controls the sheet processing unit 109 to apply the stapleless binding processing to the three positions detected in step S2315.

More specifically, as illustrated in FIG. 25B, in step S2314, the CPU 101 controls the sheet processing unit 109 to apply the stapleless binding processing to a binding position 2505. Then in step S2316, the CPU 101 applies the stapleless binding processing to the three positions, i.e., binding positions 2502, 2503, and 2504 illustrated in FIG. 25B. When the CPU 101 completes the processing in step S2316, printing is completed, and the processing in the flowchart in FIG. 23 is terminated.

Figure 26B:
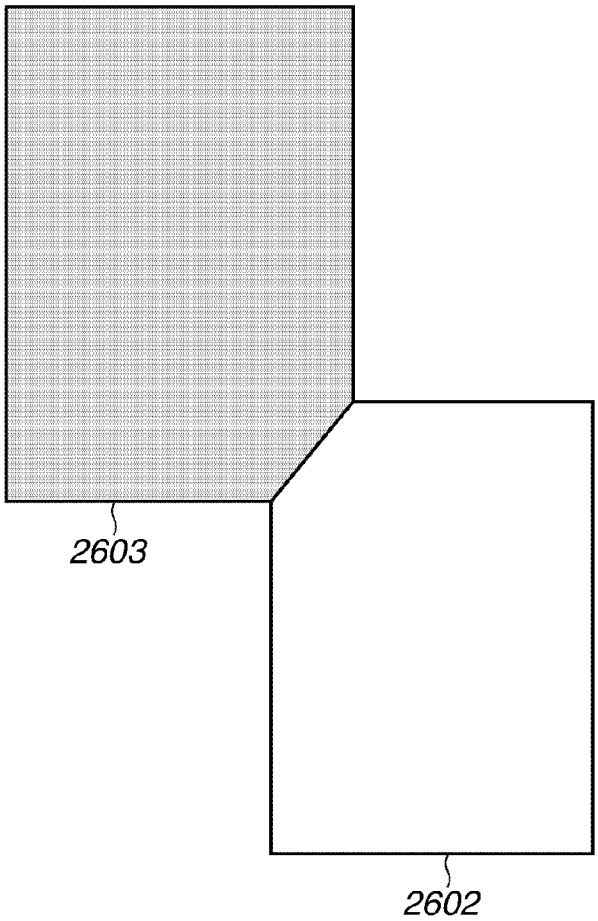

When the user rubs the binding positions 2502, 2503, and 2504 at the edges of the sheet with his/her nail or the like, as described above, the print product can be partly separated as illustrated in FIG. 26B and the user can read the contents. Since the cover needs to be removed to read the contents, it prevents the output product from being peeped by others. Further, the stapleless binding processing produces no waste staple after removing the cover.

Although, in the above-described exemplary embodiment, the stapleless binding processing is performed based on the FINISHING setting in step S2314, a case where the staple binding processing is applied to two binding positions 2701 and 2702 illustrated in FIG. 27 will be additionally described below.

Figure 27:
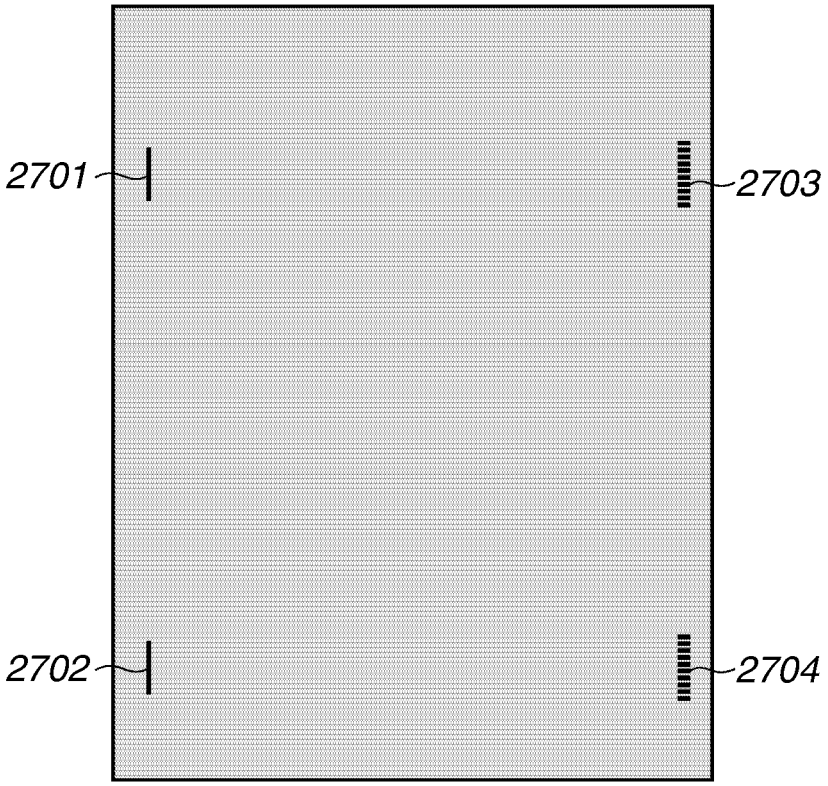
FIG. 27 illustrates binding positions.

In this case, in step S2315, the CPU 101 determines that binding positions 2703 and 2704 illustrated in FIG. 27 are not bound yet. Based on this determination result, in step S2316, the CPU 101 controls the sheet processing unit 109 to apply the stapleless binding processing to the binding positions 2703 and 2704 illustrated in FIG. 27.

Figure 28:
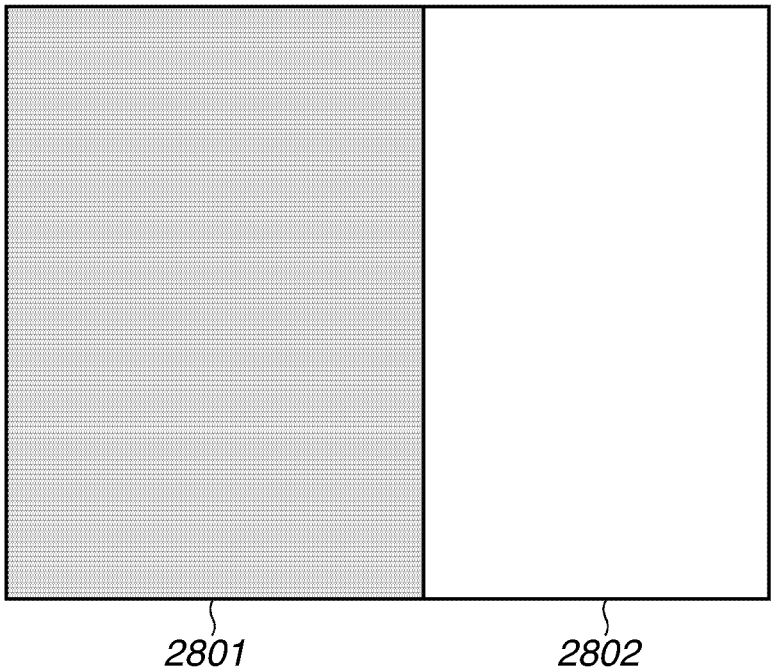
FIG. 28 illustrates a binding position.

By rubbing the binding positions 2703 and 2704 illustrated in FIG. 27 with his/her nail or the like, the user can open a cover 2801 and then read contents 2802, as illustrated in FIG. 28.

Although, in the above-described exemplary embodiment, the four corners of the sheets are bound, it is of course that the degree of anti-peeping can be improved by binding not only the four corners but also the entire sheet edges.

Although, in the above-described exemplary embodiments, binding processing is applied during a copy operation, it is of course that a similar effect can be provided by the processing in the flowchart in FIG. 23 also in a case of printing a PDL document received from a data processing apparatus. Example data processing apparatuses include a device capable of communicating with the image processing apparatus via a wired or wireless interface, and a server apparatus in the cloud computing environment.

According to the present exemplary embodiment, a user of the output product cannot be identified since the contents of the output product are hidden. Therefore, printing a user name or a job name on a cover makes it easier to identify the user.

According to the above-described present exemplary embodiment, the anti-peeping mode in which a cover is bound on the top of the print product to hide its contents enables preventing the print product from being peeped by others after printing.

According to the present exemplary embodiment, the user can easily remove the cover when he or she read the contents. Further, according to the present exemplary embodiment, the cover can be easily removed, and the need of discarding a staple is eliminated when the cover is lastly removed. Further, the user can select one of two different modes as desired, namely a mode in which a cover for hiding the contents can be removed and discarded and a mode in which the cover is not discarded.

According to the second exemplary embodiment, the user can select the removability of the cover as similar to the first exemplary embodiment, thus providing the anti-peeping mode as desired by the user.

Although, according to the present exemplary embodiment, a print job is generated from image data read by the reading unit 106, the present exemplary embodiment is also applicable to an image processing apparatus that communicates with a data processing apparatus using a communication interface 111 via a network 112 illustrated in FIG. 1. In that case, the image processing apparatus receives a print job having a trial print mode setting through communication with the data processing apparatus via the network 112. If necessary, it is also possible to provide a user of the data processing apparatus with a UI screen for selecting the stapleless binding processing in a trial print mode, and to reflect the selection by the user of the data processing apparatus to the processing of the print job.

According to the present exemplary embodiment, performing binding processing for binding a plurality of sheets without using a staple enables providing a print product with which a sheet can be easily separated from a sheet bundle after binding processing.

Aspects of the present invention can also be realized by a computer of a system or apparatus (or devices such as a CPU or an MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable storage medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-035975 filed Feb. 22, 2012, which is hereby incorporated by reference herein in its entirety.

What is claimed is:

1. A printing control apparatus for controlling a binding unit that performs an adhesiveless binding processing for binding a plurality of sheets without using a staple, the printing control apparatus comprising:

a printing unit configured to perform printing on a sheet; and a control unit configured to control the binding unit to perform a first adhesiveless binding processing at a first position for binding a plurality of sheets printed by the printing unit, and, after the first adhesiveless binding processing, control the binding unit to perform a second adhesiveless binding processing at a second position for binding the plurality of sheets bound by the first adhesiveless binding processing and a sheet different from the plurality of sheets, wherein the sheet different from the plurality of sheets is not bound in the first adhesiveless binding processing, and wherein the second position is different from the first position.

2. The printing control apparatus according to claim 1, wherein the sheet different from the plurality of sheets is placed on a top sheet of the plurality of sheets in an overlapped manner.

3. The printing control apparatus according to claim 1, wherein the sheet different from the plurality of sheets is a cover sheet.

4. The printing control apparatus according to claim 1, wherein the binding unit is configured to use pressure in the adhesiveless binding processing.

5. The printing control apparatus according to claim 1, wherein the binding unit includes a mold having a plurality of blades, and wherein the binding unit is configured to perform the second adhesiveless binding processing, for binding the plurality of sheets bound by the first adhesiveless binding processing and a sheet different from the plurality of sheets, by applying pressure to the mold to press the plurality of blades into the plurality of sheets bound by the first adhesiveless binding processing and the sheet different from the plurality of sheets.

6. The printing control apparatus according to claim 1, wherein the binding unit includes a mold having a plurality of convex shape blades, and wherein the binding unit is configured to perform the second adhesiveless binding processing, for binding the plurality of sheets bound by the first adhesiveless binding processing and a sheet different from the plurality of sheets, by applying pressure to the mold to press the plurality of convex shape blades into the plurality of sheets bound by the first adhesiveless binding processing and the sheet different from the plurality of sheets so as to weakly bind the sheet different from the plurality of sheets to the plurality of sheets bound by the first adhesiveless binding processing, so that the sheet different from the plurality of sheets can be readily unbound from the plurality of sheets bound by the first adhesiveless binding processing by rubbing the sheet different from the plurality of sheets.

7. A binding control apparatus comprising:

a binding unit configured to perform an adhesiveless binding processing for binding a plurality of sheets without using a staple; and a control unit configured to control the binding unit to perform a first adhesiveless binding processing at a first position for binding a plurality of sheets, and, after the first adhesiveless binding processing, control the binding unit to perform a second adhesiveless binding processing at a second position for binding the plurality of sheets bound by the first adhesiveless binding processing and a sheet different from the plurality of sheets, wherein the sheet different from the plurality of sheets is not bound in the first adhesiveless binding processing, and wherein the second position is different from the first position.

8. The binding control apparatus according to claim 7, wherein the binding unit is configured to use pressure in the adhesiveless binding processing.

9. A method for controlling a binding unit to perform an adhesiveless binding processing for binding a plurality of sheets without using a staple, the method comprising:

controlling the binding unit to perform a first adhesiveless binding processing at a first position for binding a plurality of sheets printed by a printing unit; and after the first adhesiveless binding processing, controlling the binding unit to perform a second adhesiveless binding processing at a second position for binding the plurality of sheets bound by the first adhesiveless binding processing and a sheet different from the plurality of sheets, wherein the sheet different from the plurality of sheets is not bound in the first adhesiveless binding processing, and wherein the second position is different from the first position.

10. A non-transitory computer-readable storage medium that stores a program that causes a computer to perform a method for controlling a binding unit to perform an adhesiveless binding processing for binding a plurality of sheets without using a staple, the method comprising:

controlling the binding unit to perform a first adhesiveless binding processing at a first position for binding a plurality of sheets printed by the printing unit; and after the first adhesiveless binding processing, controlling the binding unit to perform a second adhesiveless binding processing at a second position for binding the plurality of sheets bound by the first adhesiveless binding processing and a sheet different from the plurality of sheets, wherein the sheet different from the plurality of sheets is not bound in the first adhesiveless binding processing, and wherein the second position is different from the first position.

* * * * *